US011391106B2

(12) United States Patent
Montifar et al.

(10) Patent No.: US 11,391,106 B2
(45) Date of Patent: Jul. 19, 2022

(54) NIGHTCAP ASSEMBLY FOR CLOSING A WELLHEAD AND METHOD OF USING SAME

(71) Applicant: GR Energy Services Management, LP, Sugar Land, TX (US)

(72) Inventors: Roma Montifar, Katy, TX (US); Joel Henry, Manvel, TX (US); Bruce Schroeder, Houston, TX (US); James William Anthony, Missour City, TX (US)

(73) Assignee: GR Energy Services Management, LP, Sugar Land, TX (US)

( * ) Notice: Subject to any disclaimer, the term of this patent is extended or adjusted under 35 U.S.C. 154(b) by 0 days.

(21) Appl. No.: 16/293,345

(22) Filed: Mar. 5, 2019

(65) Prior Publication Data

US 2019/0271205 A1 Sep. 5, 2019

Related U.S. Application Data

(60) Provisional application No. 62/638,801, filed on Mar. 5, 2018.

(51) Int. Cl.

| | |
|---|---|
| ***E21B 33/03*** | (2006.01) |
| ***E21B 19/00*** | (2006.01) |
| ***E21B 21/10*** | (2006.01) |

(52) U.S. Cl.

CPC ..... *E21B 33/03* (2013.01); *E21B 19/00* (2013.01); *E21B 21/106* (2013.01)

(58) Field of Classification Search

CPC ..... E21B 33/03; E21B 21/106; E21B 19/00; E21B 19/16; E21B 33/038; E21B 21/10; E21B 19/004; E21B 33/035; E21B 23/00

See application file for complete search history.

(56) References Cited

U.S. PATENT DOCUMENTS

| | | | |
|---|---|---|---|
| 1,664,593 | A | 4/1928 | Coffman |
| 4,442,892 | A | 4/1984 | Delesandri |
| 5,005,650 | A | 4/1991 | Hopper |
| 5,107,931 | A | 4/1992 | Valka et al. |
| 6,085,837 | A | 7/2000 | Massinon et al. |
| 6,189,620 | B1 | 2/2001 | McDowell |
| 6,234,253 | B1 | 5/2001 | Dallas |
| 7,051,804 | B1 | 5/2006 | Arning |

(Continued)

OTHER PUBLICATIONS

FHE—Pressure Control Equipment, Riglock, online product brochure downloaded from the world wide web at www.builtbyfhe.com, dated at least as early as Mar. 1, 2018, pp. 1-4.

(Continued)

*Primary Examiner* — D. Andrews

(74) *Attorney, Agent, or Firm* — JL Salazar

(57) ABSTRACT

A nightcap system and assembly for closing a wellhead assembly positioned about a wellbore. The nightcap assembly includes a boom and a hoist. The boom includes a boom cylinder connectable to the wellhead assembly and a boom piston extendable from the cylinder. The hoist includes a hoist cylinder connectable to the wellhead assembly and a hoist piston extendable therefrom. The hoist piston includes a nightcap support to carry a nightcap. The hoist is connectable to the boom piston and movable therewith whereby the nightcap may be inserted into an opening of the wellhead assembly.

26 Claims, 27 Drawing Sheets

(56) References Cited

U.S. PATENT DOCUMENTS

| | | | | |
|---|---|---|---|---|
| 7,096,963 | B2 | 8/2006 | Moncus et al. | |
| 7,219,740 | B2 | 5/2007 | Saucier | |
| 7,341,109 | B1 | 3/2008 | McDowell | |
| 9,551,195 | B1 * | 1/2017 | Baryam | E21B 19/163 |
| 9,644,443 | B1 | 5/2017 | Johansen et al. | |
| 9,670,745 | B1 | 6/2017 | Johansen et al. | |
| 9,683,425 | B2 | 6/2017 | Hallundbæk et al. | |
| 9,879,496 | B2 | 1/2018 | Johansen et al. | |
| 9,890,618 | B1 * | 2/2018 | Goodman | E21B 17/01 |
| 9,903,168 | B2 * | 2/2018 | Ellis | E21B 19/16 |
| 9,976,362 | B2 | 5/2018 | Rahim et al. | |
| 10,030,461 | B2 | 7/2018 | Johansen et al. | |
| 10,072,474 | B2 | 9/2018 | Johansen et al. | |
| 10,309,180 | B2 | 6/2019 | Johansen et al. | |
| 10,392,894 | B2 | 8/2019 | Kibler et al. | |
| 2003/0178200 | A1 | 9/2003 | Fox et al. | |
| 2003/0226248 | A1 * | 12/2003 | McGuffin | E21B 19/24<br>29/525.01 |
| 2005/0217844 | A1 | 10/2005 | Edwards et al. | |
| 2007/0251700 | A1 * | 11/2007 | Mason | E21B 19/06<br>166/379 |
| 2008/0210435 | A1 | 9/2008 | Goonetilleke et al. | |
| 2008/0257032 | A1 * | 10/2008 | Zollo | E21B 43/38<br>73/152.29 |
| 2010/0025044 | A1 | 2/2010 | McKay et al. | |
| 2010/0148412 | A1 * | 6/2010 | Murakami | F16F 9/56<br>267/118 |
| 2011/0048735 | A1 | 3/2011 | Fuss et al. | |
| 2011/0214917 | A1 | 9/2011 | Boudreaux | |
| 2013/0153237 | A1 | 6/2013 | McGuire | |
| 2013/0206419 | A1 | 8/2013 | Hallundbæk et al. | |
| 2014/0124686 | A1 | 5/2014 | Hallundbæk et al. | |
| 2015/0226048 | A1 | 8/2015 | Thurman | |
| 2015/0368993 | A1 * | 12/2015 | Fournier | E21B 25/08<br>175/52 |
| 2016/0273295 | A1 * | 9/2016 | Rahim | E21B 19/00 |
| 2017/0159390 | A1 | 6/2017 | Johansen et al. | |
| 2017/0268305 | A1 | 9/2017 | Johansen et al. | |
| 2018/0080299 | A1 | 3/2018 | Johansen et al. | |
| 2018/0179846 | A1 | 6/2018 | Johansen et al. | |

OTHER PUBLICATIONS

GR Energy Services, RigLock Remote Wellhead Rig-up/Rig-down Equipment, dated at least as early as Nov. 18, 2016, pp. 1-2.

* cited by examiner

NIGHTCAP ASSEMBLY FOR CLOSING A WELLHEAD AND METHOD OF USING SAME

CROSS-REFERENCE TO RELATED APPLICATION

This application claims the benefit of U.S. Patent Application No. 62/638,801 filed on Mar. 5, 2018, the entire contents of which is hereby incorporated by reference herein.

BACKGROUND

The present disclosure relates generally to oilfield technology. More specifically, the present disclosure relates to devices for closing (e.g., securing, capping, and/or sealing) wellheads and/or wellbores at a wellsite.

Wells are drilled into subsurface formations to reach subsurface targets, such as valuable hydrocarbons. Drilling equipment is positioned at the surface and drilling tools are advanced into the subsurface formation to form wellbores. Once drilled, casing is inserted into the wellbore and cemented into place.

Wellheads are positioned at the opening of the wellbore and secured to the casing. The wellhead supports various surface equipment for performing wellsite operations. See, e.g., Patent/Application Nos. US2016/0273295, U.S. Pat. Nos. 4,442,892, 7,341,109, 5,107,931, 7,051,804, US20080210435 and U.S. Pat. No. 5,005,650, the entire contents of which are hereby incorporated by reference herein. In some cases, pressure control equipment, such as blowout preventers, are connected to the wellhead and activated at increased pressures to prevent blowouts.

Downhole equipment is deployed through the wellhead and into the wellbore for performing downhole operations. See, e.g., Patent/Application Nos. U.S. Pat. Nos. 6,085,837, 9,683,425, and US20150226048, the entire contents of which are hereby incorporated by reference herein. In some cases, downhole equipment is deployed through the surface equipment and the wellhead. For example, downhole injection tools can be lowered through the pressure control equipment, the wellhead, and into the wellbore.

Despite the advancements in oilfield and/or wellhead technology, there remains a need to quickly and safely close the wellbores. The present disclosure is directed at providing such needs.

SUMMARY

In at least one aspect, the present disclosure relates to a nightcap assembly for closing a wellhead assembly positioned about a wellbore. The nightcap assembly comprises a boom and a hoist. The boom comprises a boom cylinder connectable to the wellhead assembly and a boom piston extendable from the cylinder. The hoist comprises a hoist cylinder connectable to the wellhead assembly and a hoist piston extendable therefrom. The hoist piston comprises a support member to carry a nightcap. The hoist is connectable to the boom piston and movable therewith whereby the nightcap may be inserted into an opening of the wellhead assembly.

The nightcap assembly further comprises a nightcap support. The hoist and the boom are connectable to the wellhead assembly by the nightcap support. The nightcap support comprises a ring with wings. The boom piston is slidably connected to the hoist by a slider.

The nightcap assembly further comprises eyebolts connecting the boom piston to the slider, and/or eyebolts connecting each of the hoist pistons to the support member. The wellhead assembly comprises a wellhead, and/or further comprises a hydraulic disconnect.

The nightcap assembly further comprises a remote actuator to selectively extend and retract the boom piston and the hoist piston. The remote actuator comprises a hydraulic pump.

In another aspect, the disclosure relates to a nightcap system for closing a wellhead assembly positioned about a wellbore. The nightcap assembly comprises a nightcap, a boom and a piston. The boom comprises a boom cylinder connectable to the wellhead assembly and a boom piston extendable from the cylinder. The hoist comprises a hoist cylinder connectable to the wellhead assembly and a hoist piston extendable therefrom. The hoist piston comprises a support member to carry a nightcap. The hoist is connectable to the boom piston and movable therewith whereby the nightcap may be inserted into an opening of the wellhead assembly.

The nightcap system further comprises a hydraulic disconnect. The hydraulic disconnect comprises a sealer to sealingly engage with the nightcap. The sealer comprises a clamp comprising dogs rotatable into sealing engagement with the nightcap.

Finally, in another aspect, the disclosure relates to a method of closing a wellhead assembly positioned about a wellbore. The method comprises connecting a boom and a hoist to the wellhead assembly, connecting the hoist to the boom, supporting a nightcap on the hoist, and inserting the nightcap into the opening of the wellhead assembly by selectively extending the boom and the hoist.

The inserting comprises remotely activating the boom and the hoist. The connecting the hoist to the boom comprises slidably connecting the hoist to the boom, and/or slidably connecting the boom to the hoist. The inserting comprises: extending the hoist; extending the boom; retracting the hoist; and retracting the boom. The inserting further comprises rotating the hoist and the boom.

The disclosure also relates to an apparatus for closing a wellhead, comprising: a nightcap; and a nightcap assembly.

This Summary is not intended to be limiting and should be read in light of the entire disclosure including text, claims and figures herein.

BRIEF DESCRIPTION OF THE DRAWINGS

So that the above recited features and advantages of the present disclosure can be understood in detail, a more particular description of the invention, briefly summarized above, may be had by reference to the embodiments thereof that are illustrated in the appended drawings. The appended drawings illustrate example embodiments and are, therefore, not to be considered limiting of its scope. The figures are not necessarily to scale and certain features, and certain views of the figures may be shown exaggerated in scale or in schematic in the interest of clarity and conciseness.

DETAILED DESCRIPTION

The description that follows includes exemplary apparatus, methods, techniques, and/or instruction sequences that embody techniques of the present subject matter. However, it is understood that the described embodiments may be practiced without these specific details.

This disclosure relates to wellhead assemblies positioned at an opening of a wellbore of a wellsite. The wellhead assemblies are provided with nightcap assemblies positioned about the wellhead for closing (e.g., securing, capping, and/or sealing) the wellbore. The nightcap assemblies may be retractable to allow access through the wellhead, and activatable to secure the wellbore in a closed position. The nightcap assembly may be attached to the wellhead and moved between an open and the closed position by remote actuation.

The nightcap assembly may be removably connected to the wellhead and/or other portion of the wellhead assembly. The nightcap assembly may be automatically and/or manually, remotely and/or locally activated to selectively open and close the wellhead assembly. The nightcap assembly may be configured for use with a variety of surface, downhole, wellhead, and/or associated equipment.

The nightcap assembly may be provided with features, such as single piston, dual piston, hinged configurations, and various boom configurations to facilitate lifting, placing, and supporting the nightcap. The nightcap assembly may also be provided with one or more of the following among other features: efficient installation and/or operation, hands free operation, increased safety, flexible operation, adaptability to various wellsites, remote actuation, balanced forces, ease of installation, ease of transfer between wellheads, ease of actuation, ease of insertion and/or removal, usable with wellheads having one or more wellhead valves, capable of sealing with the wellhead equipment, etc.

Figure 1:
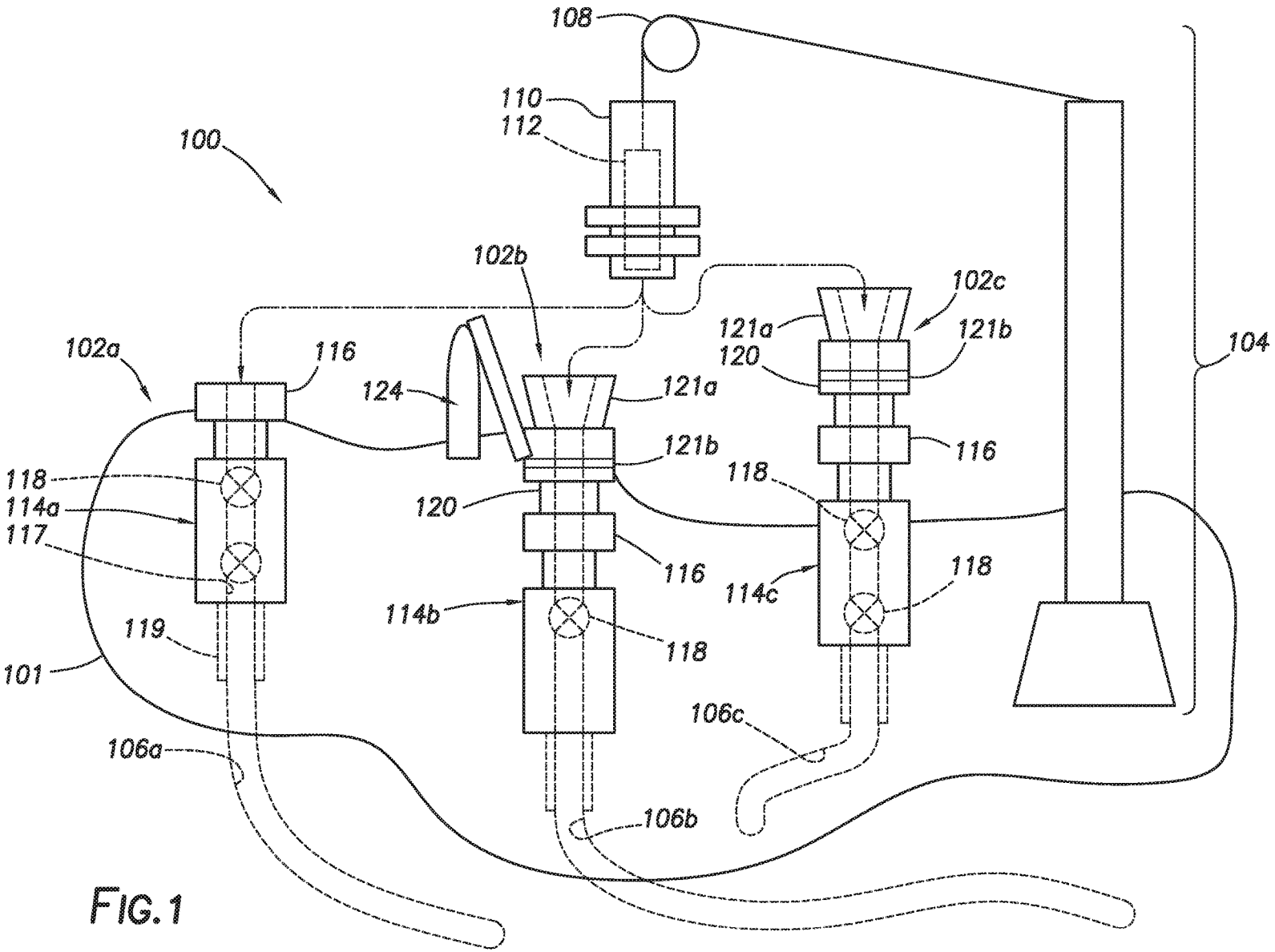
FIG. 1 is a schematic diagram depicting a pad with multiple wellsites, the wellsites having a wellhead assembly, a wellhead assembly with a nightcap assembly and a hydraulic disconnect, and a wellhead assembly with a hydraulic disconnect, respectively.

FIG. 1 is a schematic diagram depicting a wellsite 100 having a pad 101 with multiple wells 102*a-c*. The wells 102*a-c* have wellbores 106*a-c*, the wellbores 106*a-c* having various shapes and sizes that extend into the subterranean formation as indicated by the dashed lines. The wellsite 100 may include surface equipment 104 positioned about the pad 101. While a pad 101 with three production wells 102*a-c* are depicted, any number of wells may be positioned about one or more pads of one or more wellsites. The example shown is not intended to be limited to a specific application or configuration.

The surface equipment 104 may include a crane 108, pressure control equipment 110, downhole equipment 112, and wellhead assemblies 114*a-c*. The crane 108 (or other lifting and/or transport equipment) may be positioned at the wellsite 100 for deploying the pressure control equipment 110 (and/or other equipment) about the wellsite 100. The crane 108 may be used to selectively carry the pressure control equipment 110 to and/or from one or more of the wells 102*a-c* for connection to the wellhead assemblies 114*a-c*.

The pressure control equipment 110 may be, for example, a blowout preventer, wireline lubricator, and/or other surface equipment positionable about the wellsite 100. The pressure control equipment 110 may have the downhole equipment 112 positioned therein. The downhole equipment 112 may be, for example, a downhole tool (e.g., injection tool) to be deployed through the pressure control equipment 110 and into the wellbores 106*a-c* for performing downhole operations.

The wellhead assemblies 114*a-c* are positioned about each of the wellbores 106*a-c*, respectively, after the wellbores 106*a-c* are drilled and completed. The wellhead assemblies 114*a-c* each include a wellhead 116 made of metal tubing positioned about an opening of the wellbores 106*a-c* to secure equipment, such as a Christmas tree, at an uphole end thereof. A downhole end of the wellhead 116 may be secured to casing 119 lining the wellbores 106*a-c*.

Each wellhead assembly 114*a-c* has a passage 117 in fluid communication with the wellbore, and valve(s) 118 positioned about the passage 117 to restrict fluid flow therethrough. Each of these wellhead assemblies 114*a-c* may selectively permit the downhole equipment 112 to pass through the passage 117 and into the wellbores 106*a-c*. Each of the valves 118 may selectively open and close to selectively isolate fluid flow through the passage 117.

The wells 102*a-c* show various devices that may be used for assuring that the wellhead assembly 114*a-c* is closed. These devices may be means for closing (or capping) the well 102*a-c* to assure that no material enters or exits the wellbores 106*a-c*. The wellhead assemblies 114*a-c* are depicted as having one or more individual valves 118 along the passage 117. For descriptive purposes, these valves 118 are schematically depicted as discrete valves positioned along certain parts of the passage 117, but each valve may be a more complex hydraulic assembly capable of closing a portion of the passage 117.

The wellhead assembly 114*a* includes two valves 118 for closing well 102*a*. In this configuration, when no pressure control equipment 110 is attached to the wellhead 116, the valves 118 are both closed. Once the crane 108 places the pressure control equipment 110 on the wellhead 116 and it is secured in place (e.g., bolted onto the wellhead 116), both valves 118 are opened to allow the downhole equipment 112 to pass into the wellbore 106*a*.

The wellhead assembly 114*c* is similar to the wellhead assembly 114*a* (including two valves), except that it also includes a hydraulic disconnect 120 positioned about an inlet of the wellhead assembly 114*c*. The hydraulic disconnect 120 may be a device positioned about an inlet of the wellhead assembly 114*c* to receive and engage the pressure control equipment 110 at the wellhead 116. In the example shown, the hydraulic disconnect 120 has a funnel shaped inlet or tulip 121*a* to receive the pressure control equipment 110. The hydraulic disconnect 120 also has a clamp 121*b* to grippingly engage the pressure control equipment 110 that passes into the hydraulic disconnect 120 to form a seal therewith.

The wellhead assembly 114*b* of well 102*b* is similar to the wellhead assembly 114*c*, except that it has only one valve 118 and also includes a nightcap assembly 124. The ring nightcap assembly 124 is positioned about the hydraulic disconnect 120 to insert a nightcap assembly 124 into the wellhead assembly 114*b*. Like the pressure control equipment 110 of well 102*c*, the ring nightcap assembly 124 may be sealingly engaged by the clamp 121*b* of the hydraulic disconnect 120 to seal the passage 117 and close the wellhead assembly 114*b* and the well 102*b* as is described further herein.

While FIG. 1 shows various wells 102*a-c* with various configurations to close the passage 117 and seal the wellbore 106*a-c*, a variety of configurations may be provided. In these examples, when the pressure control equipment 110 is secured to the wellhead assembly 114, the valves are open to permit passage of the downhole equipment 112 through the passage 117 and into the wellbore 106*a-c*.

Figure 2:
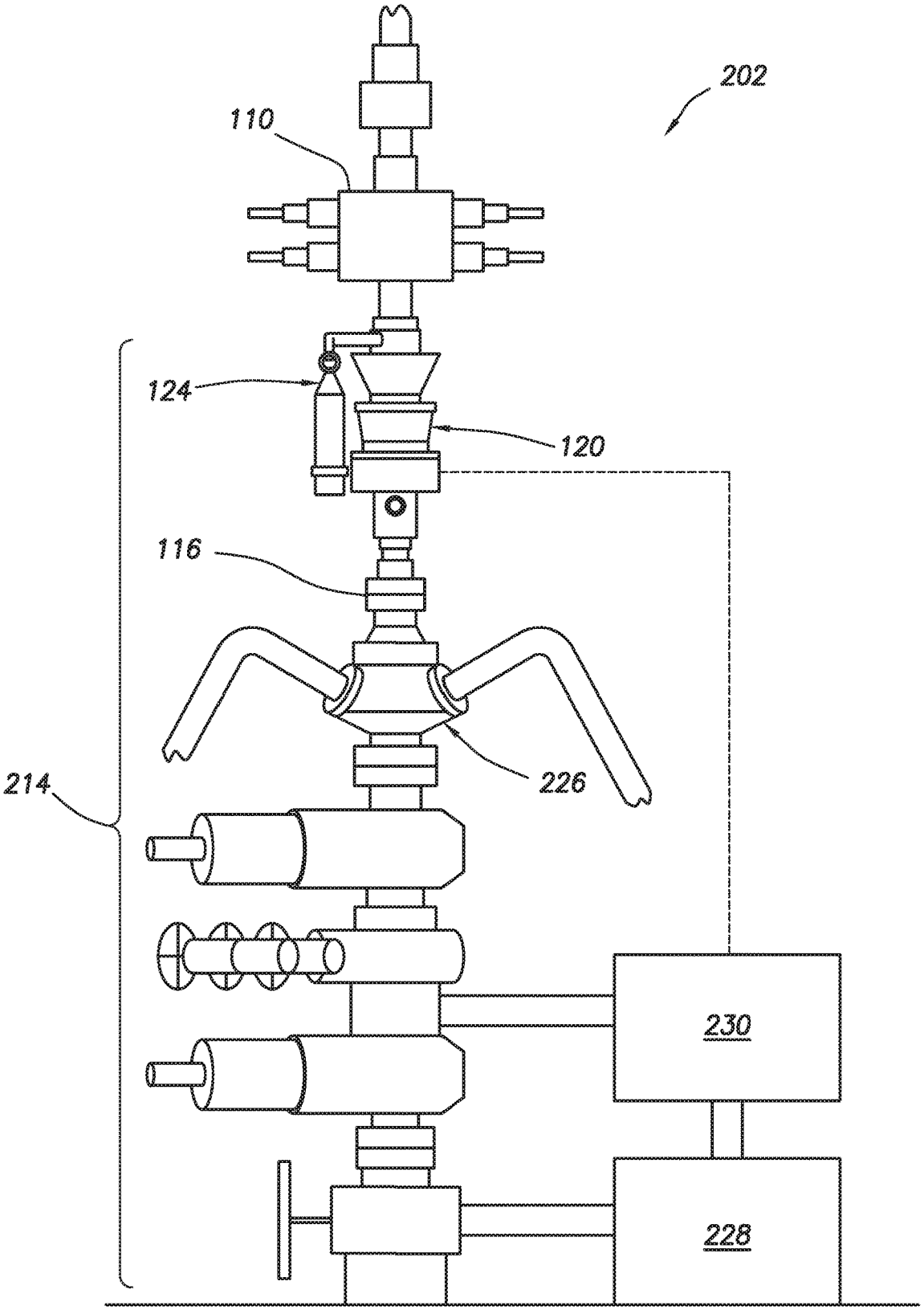
FIG. 2 is a schematic diagram depicting the wellhead assembly with the nightcap assembly.

FIG. 2 is a schematic diagram depicting an example well 202 in which the ring nightcap assembly 124 may be used. The well 202 includes a wellhead assembly 214, the pressure control equipment 110, the hydraulic disconnect 120, and the ring nightcap assembly 124. In this example, the pressure control equipment 110 is connected to the hydraulic disconnect 120.

The wellhead assembly 214 may include the wellhead 116 and the hydraulic equipment 226. The hydraulic equipment 226 may be connected between the wellhead 116 and the casing in the wellbore (not shown). The hydraulic equipment 226 may include devices, such as pressure control equipment, pumping, and/or other equipment for operating the well 202. The hydraulic disconnect 120 may be any device capable of hydraulically disconnecting the wellhead 116, such as RIGLOCK™ commercially available from FHE™ at www.builtbyfhe.com.

As also shown in FIG. 2, the well 202 may have a surface unit 228 and a hydraulic unit 230. The surface unit 228 may include various devices, such as a central processing unit (CPU), input/output (I/O) devices, power supplies, transceivers, wired and/or wireless connections, measuring devices (e.g., gauges, transducers, etc.), for operating the surface equipment. The hydraulic unit 230 may include hydraulic equipment 226, such as pumps, fluid sources, etc., for providing pressurized fluid to and/or releasing pressurized fluid from the well 202. This hydraulic unit 230 may be coupled to the hydraulic disconnect 120 and/or the ring nightcap assembly 124 for hydraulic actuation thereof as is described further herein.

Figure 3A:
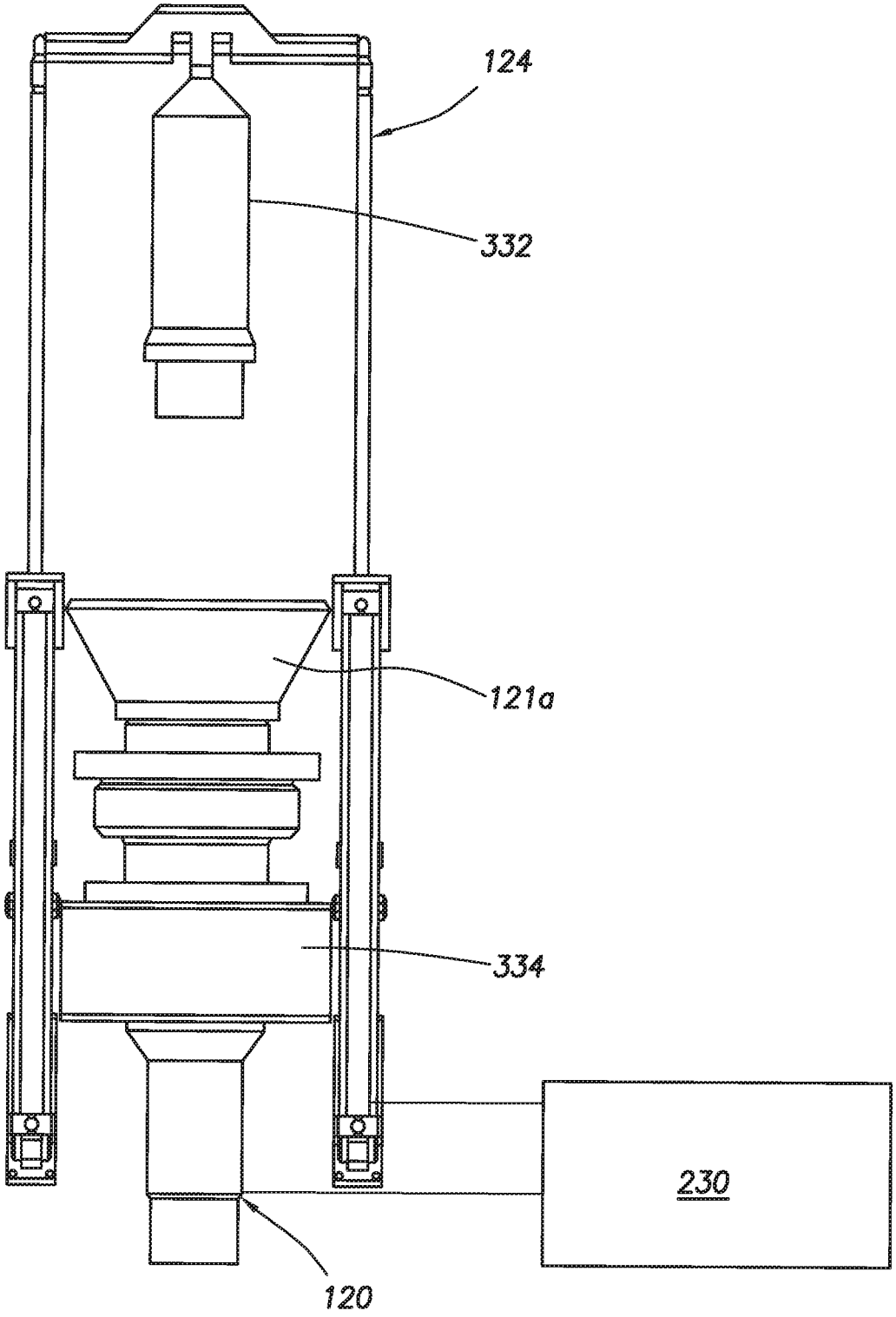
FIGS. 3A-3B are front view and side view, respectively, of the wellhead assembly with a ring nightcap assembly.
Figure 3B:
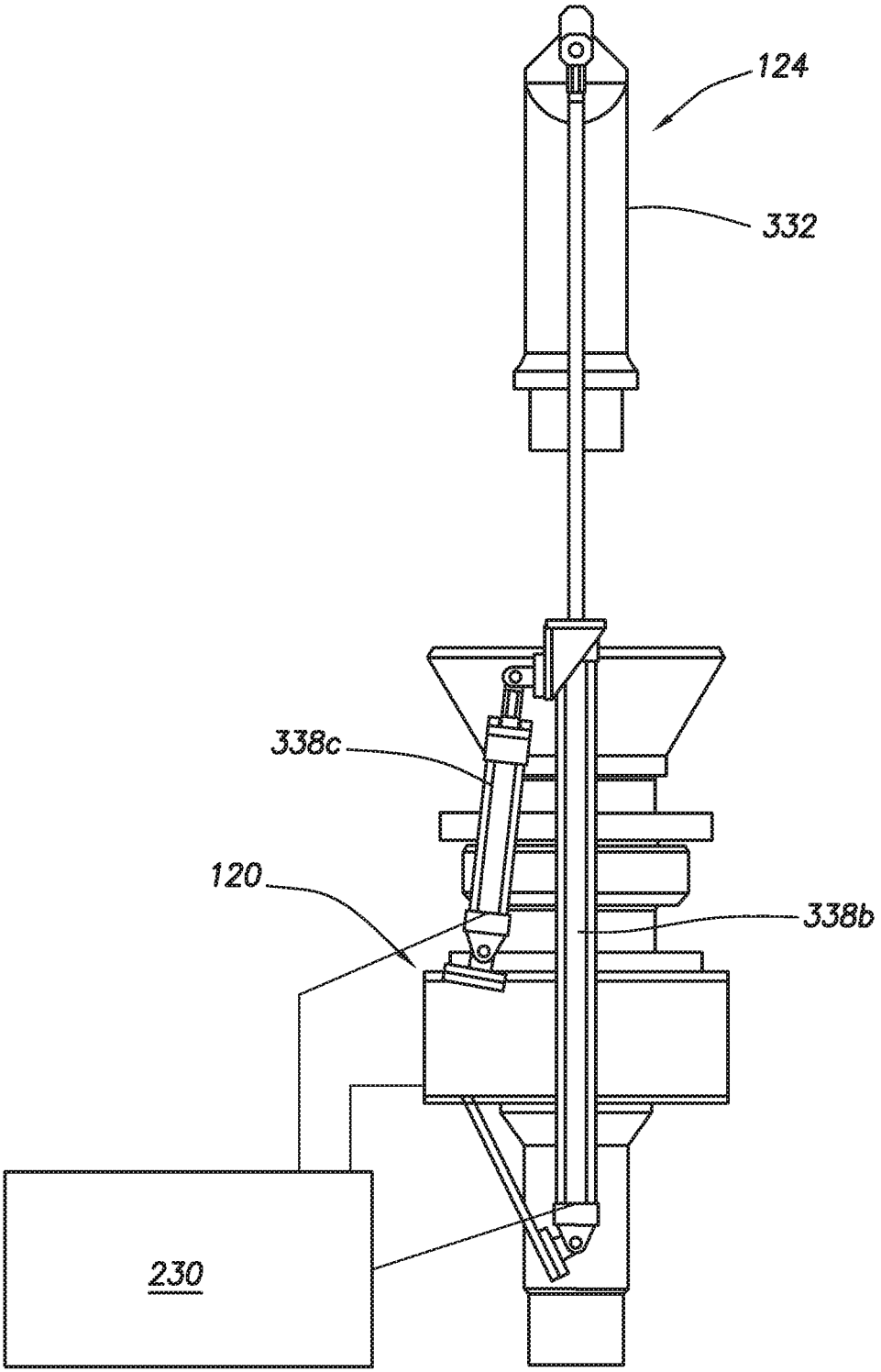
Figure 4:
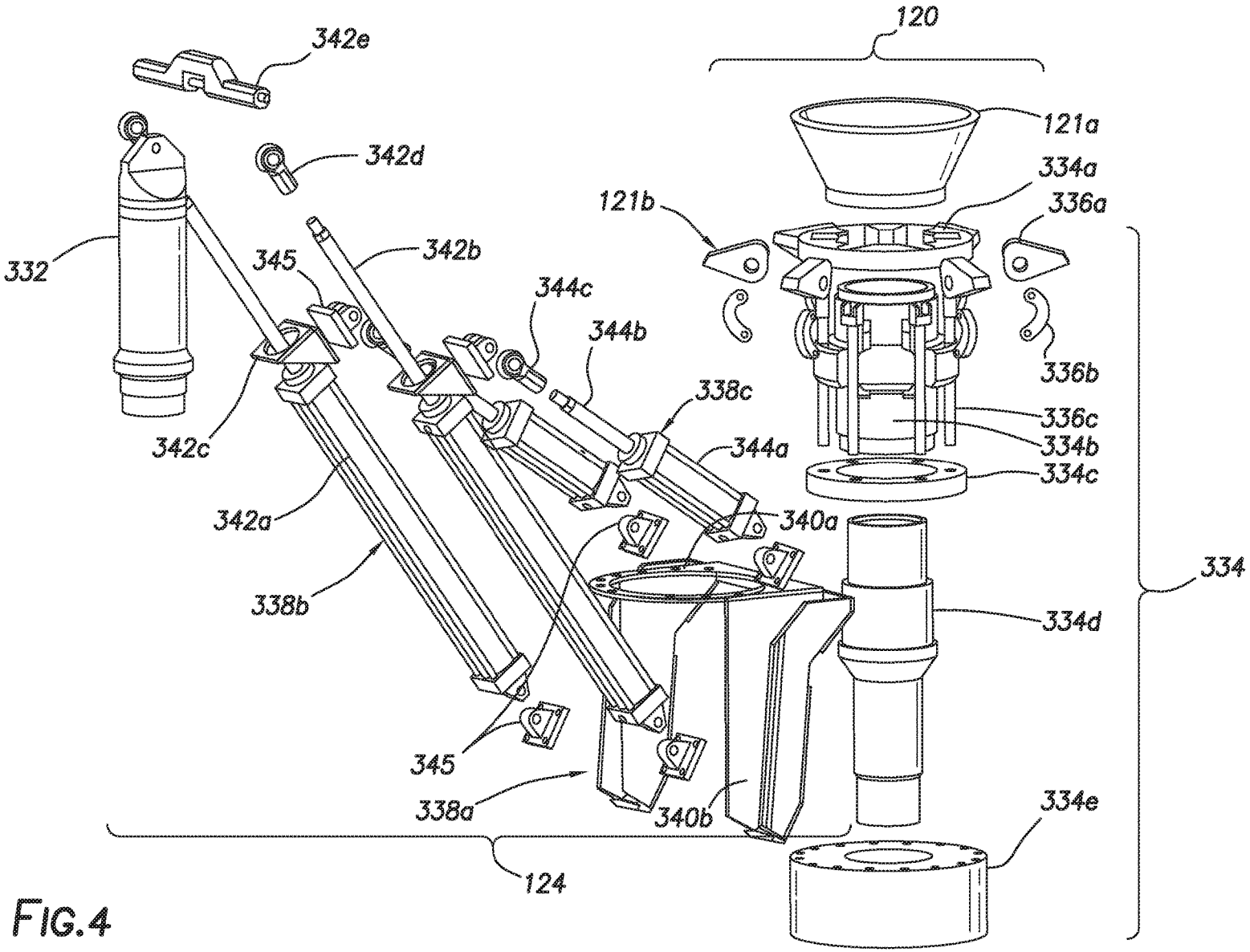
FIG. 4 is an exploded view of the wellhead assembly with the ring nightcap assembly.

FIGS. 3A-6D show various views of the hydraulic disconnect 120 and the ring nightcap assembly 124 in a ring configuration. FIGS. 3A, 3B, and 4 show front, side, and exploded views, respectively, of the hydraulic disconnect 120 and the ring nightcap assembly 124. FIGS. 5A and 5B show longitudinal cross-sectional views of the ring nightcap assembly 124 in the open position and the closed position, respectively. FIGS. 6A-6D show an example operation using the ring nightcap assembly 124. As shown by these figures, the ring nightcap assembly 124 carries the nightcap 332 for insertion into the passage 117 of the hydraulic disconnect 120. The nightcap 332 is shaped for receipt into the passage 117 and for sealing engagement by the hydraulic disconnect 120.

Referring first to FIGS. 3A-5B, the hydraulic disconnect 120 includes the tulip 121*a*, the clamp 121*b*, and the base 334. The tulip 121*a* is a funnel shaped member shaped to receive the pressure control equipment (110 of FIG. 1). The tulip 121*a* is supported on the base 334. The base 334 defines a structure for receiving and supporting the pressure control equipment 110, and for movably supporting the ring nightcap assembly 124.

The base 334 includes a tulip ring 334*a*, a sleeve 334*b*, a sleeve ring 334*c*, a shaft 334*d*, and a wellhead connector 334*e*. The sleeve 334*b* and the shaft 334*d* are tubular members defining the passage 117 for receiving the downhole tool 112 (FIG. 1). The sleeve 334*b* is threadedly connected to the tulip ring 334*a* at one end and the shaft 334*d* at the other end. The shaft 334*d* is connected to the wellhead 116 (FIG. 1).

The tulip ring 334*a* is slidably positioned about a periphery of an upper end of the sleeve 334*b*. The sleeve ring 334*c* is threadedly connected about the periphery of a lower end of the sleeve 334*b* and the wellhead connector 334*e* is threadedly connected about a periphery of the shaft 334*d*. The wellhead connector 334*e* is positioned adjacent the sleeve ring 334*c*.

The clamp 121*b* is movably connected to the sleeve 334*b*. The clamp 121*b* includes dogs 336*a*, pivots 336*b*, and long bolts 336*c*. The dogs 336*a* have holes 337*a*, receptacles 337*b*, and tips 337*c*. The holes 337*a* are shaped to receive portions of the sleeve 334*b* such that the dogs 336*a* are rotatably connected about openings in the sleeve 334*b*. Shoulders of the dogs 336*a* may be moved through the sleeve 334*b* to engage the nightcap 332. The tips 337*c* engage an inner surface of the tulip ring 334*a*. The long bolts 336*c* extend through the sleeve ring 334*c* and the wellhead connector 334*e*. The long bolts 336*c* are slidably movable through the sleeve ring 334*c* and the wellhead connector 334*e* as the locking dogs 336*a* and the pivots 336*b* rotate as is described further herein.

The ring nightcap assembly 124 includes a nightcap support 338*a*, boom 338*b*, hoist 338*c*, and the nightcap 332. The nightcap support 338*a* includes a support ring 340*a* and support wings 340*b*. The support ring 340*a* is positioned on the sleeve ring 334*c* and/or the wellhead connector 334*e*. The support wings 340*b* include a pair of fixed portions that extend below the support ring 340*a* and a pair of movable portions pivotally connected to the fixed portions.

The boom 338*b* includes a pair of boom cylinders 342*a* pivotally connected to an end of the movable portions of the support wings 340*b*. Each boom cylinder 342*a* includes a boom piston 342*b* extendable therefrom and sliders 342*c* movably positioned along the boom pistons 342*b*. Each of the sliders 342*c* may be fixed to the boom 338*b*, with each slider 342*c* having holes therethrough to slidingly receive the boom pistons 342*b*. Boom eyebolts 342*d* are connected to an end of each piston 342*b*. A support member 342*e* is connected to the boom eyebolts 342*d* and supports the nightcap 332 thereon. The support member 342*e* is shown as a bar to rotatably support the nightcap 332.

The hoist 338*c* includes a pair of hoist cylinders 344*a* with hoist pistons 344*b* and hoist eyebolts 344*c*. The hoist pistons 344*b* extend from the hoist cylinders 344*a* and have the hoist eyebolts 344*c* at an end thereof. Connectors 345 pivotally connect the boom cylinders 342*a* and the hoist cylinders 344*a* to the nightcap support 338*a*, and the hoist eyebolts 344*c* to the sliders 342*c*.

FIGS. 6A-6D show a sequence of operation of the ring nightcap assembly 124. FIGS. 6A-6D show the ring nightcap assembly 124 in the retracted, extended, lifted, and closed positions, respectively. In the retracted position of FIG. 6A, the ring nightcap assembly 124 supports the nightcap 332 adjacent the hydraulic disconnect 120 for insertion into the passage 117 to close and seal the wellhead 116 (FIG. 1).

Figure 6A:
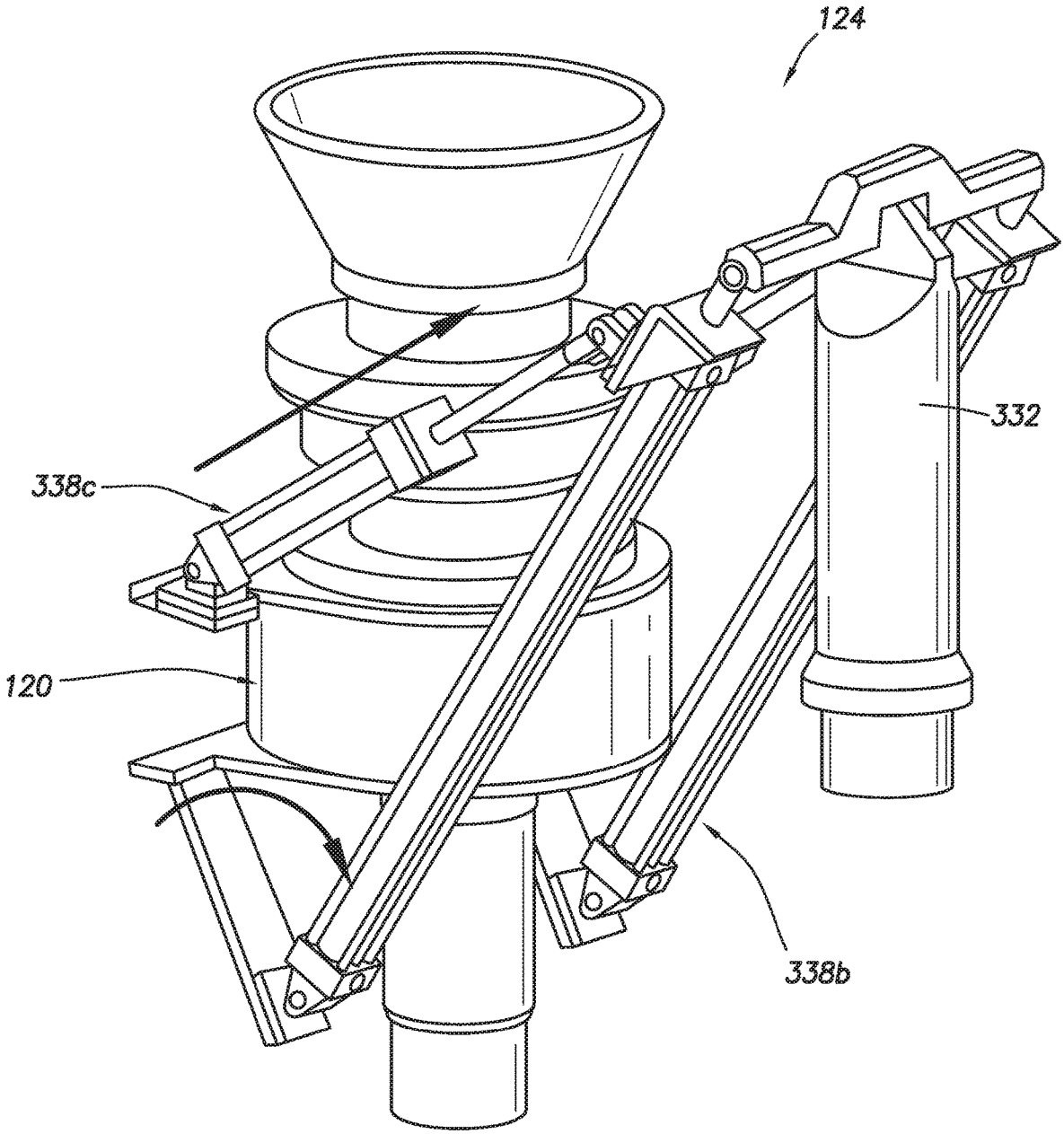
FIGS. 6A-6D are schematic views of the wellhead assembly depicting a sequence of operation of the ring nightcap assembly.
Figure 6B:
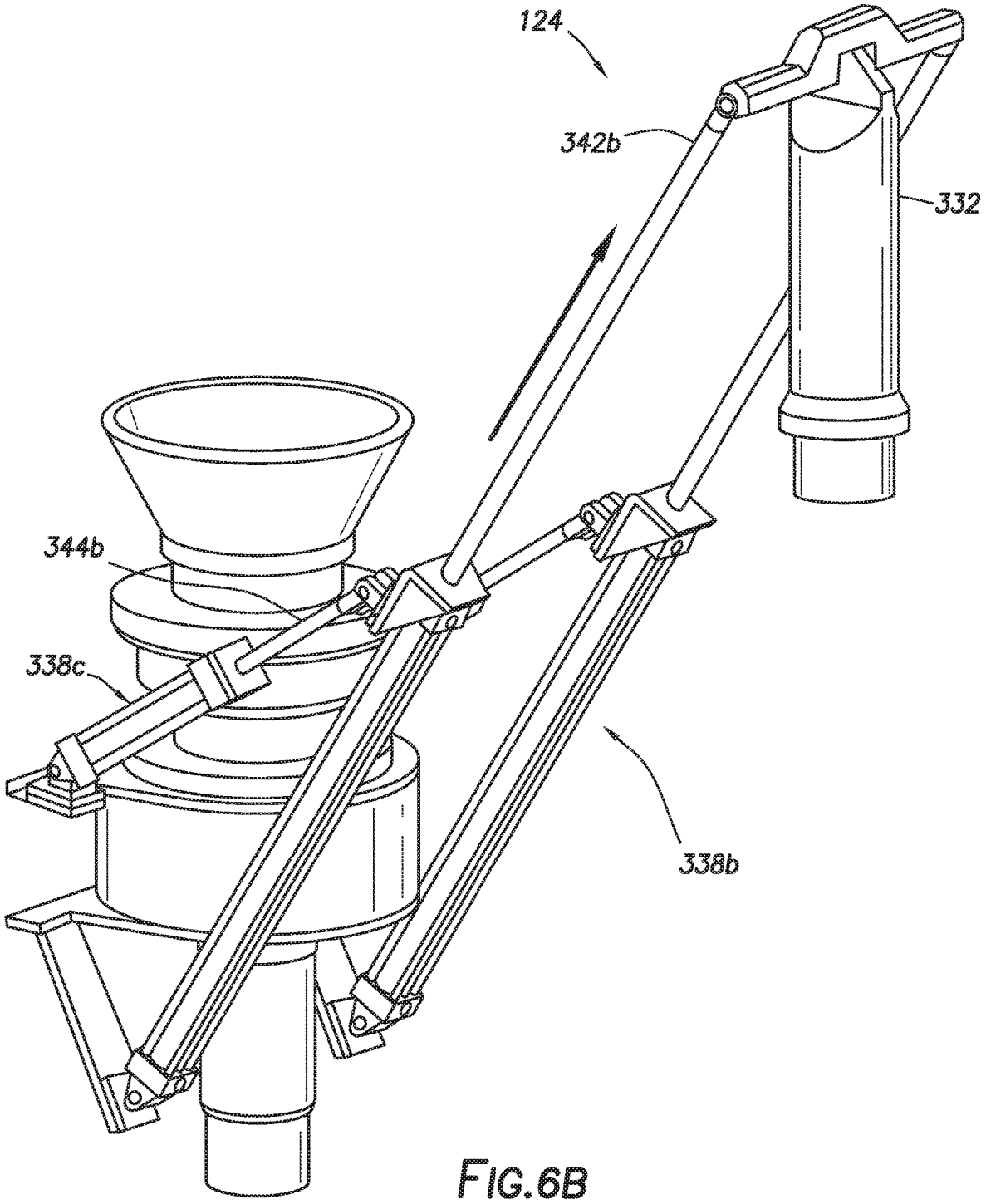

In the retracted position of FIG. 6A, the boom piston 342*b* of the boom 338*b* is retracted and the hoist piston 344*b* of the hoist 338*c* is extended. The boom 338*b* is rotated by extension of the hoist piston 344*b* as indicated by the curved arrow. In the extended position of FIG. 6B, the boom piston 342*b* of the boom 338*b* extends to move the nightcap 332 outward as indicated by the arrow.

Figure 5B:
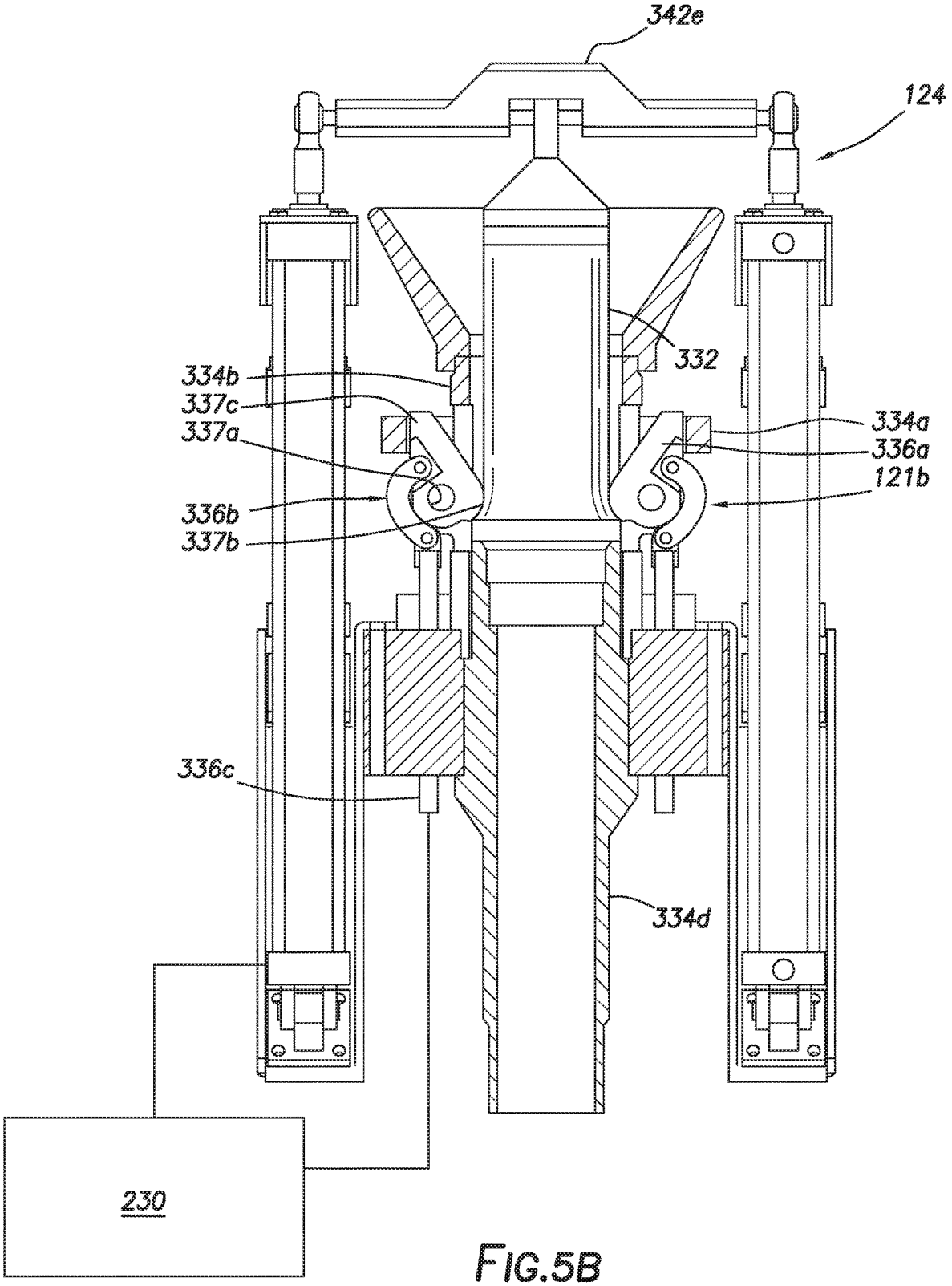
Figure 6C:
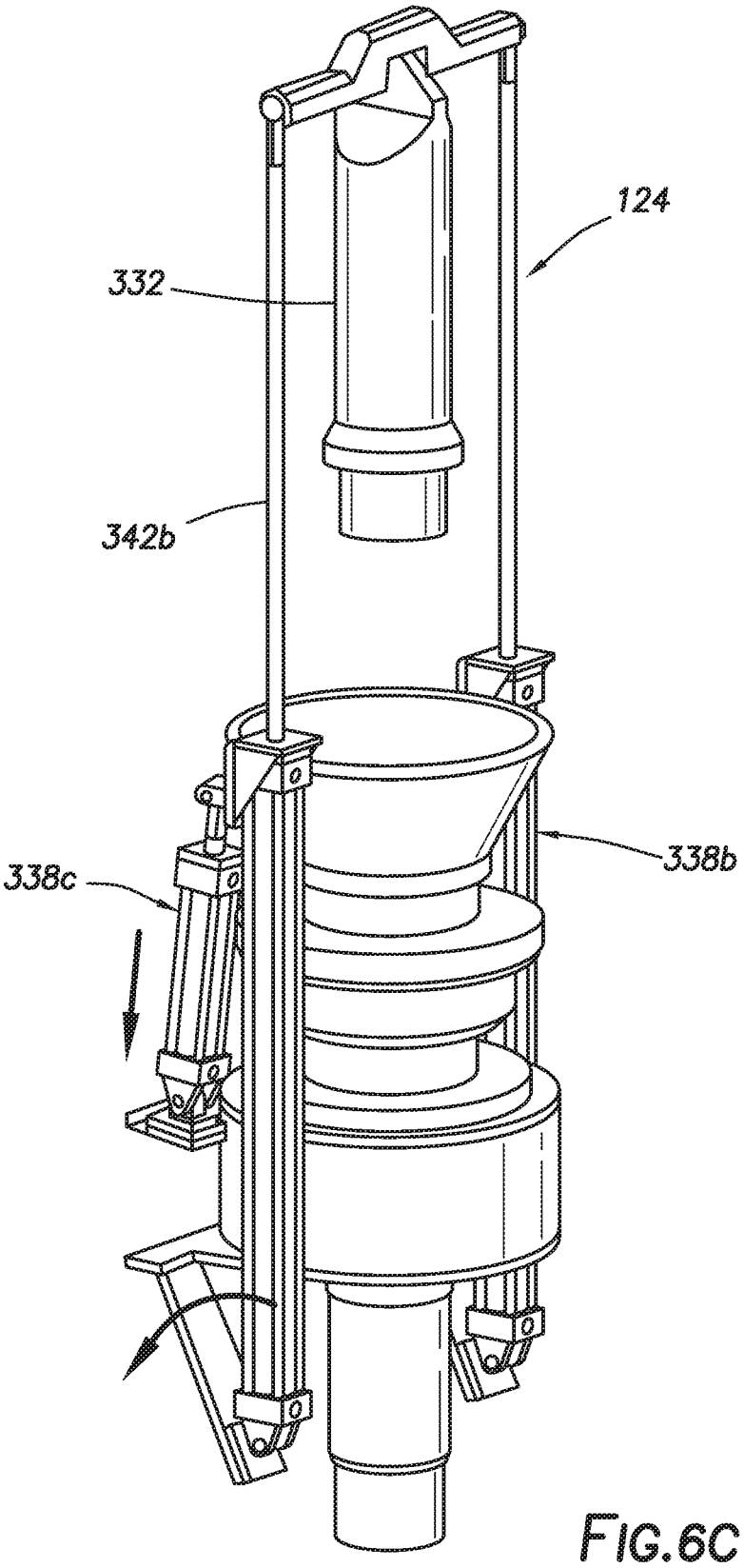
Figure 6D:
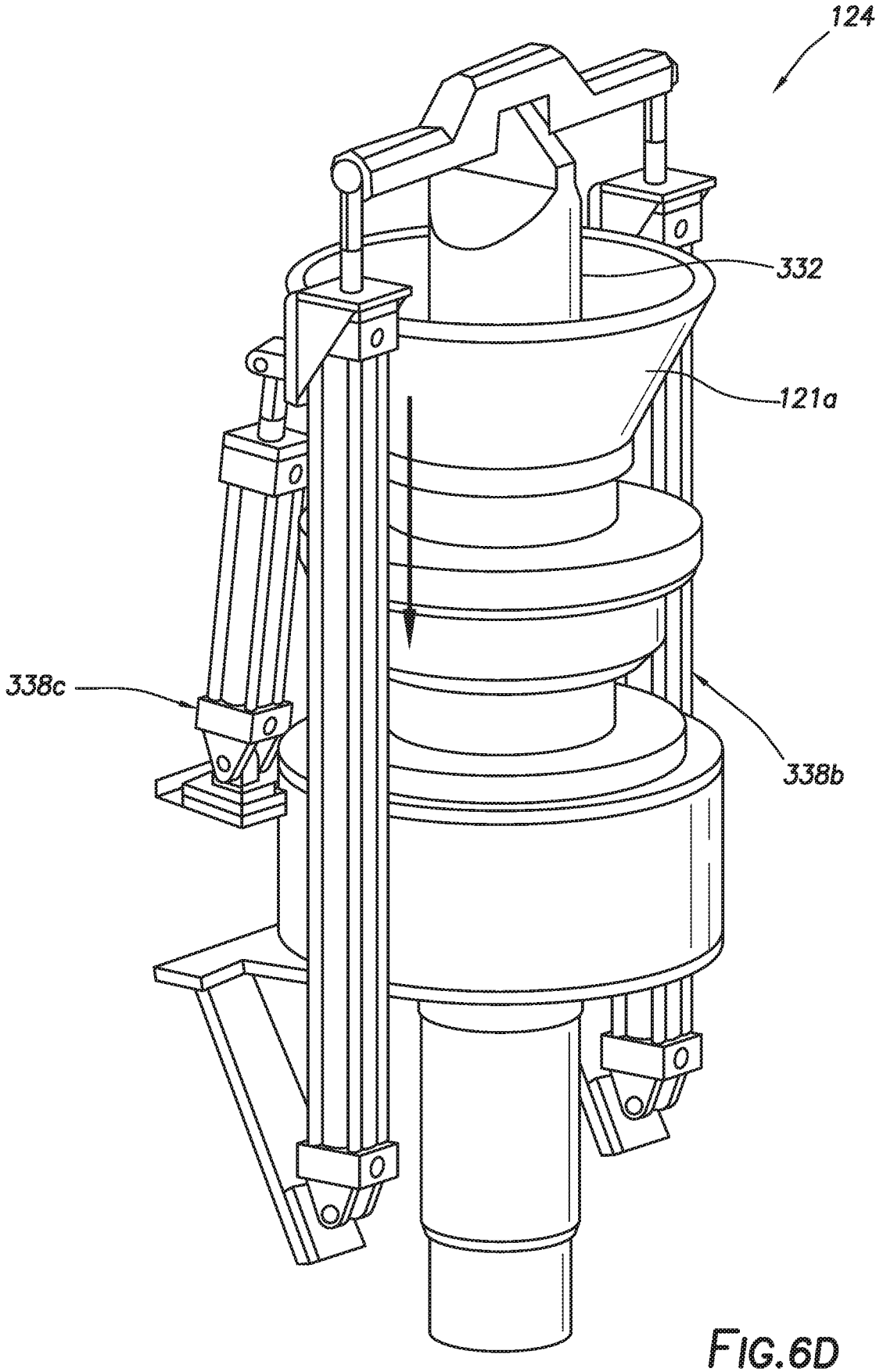

In the lifted position of FIG. 6C, the piston 342*b* of the boom 338*b* remains extended as the piston 344*b* of hoist 338*c* is retracted as indicated by the straight arrow. The retraction of the piston 344*b* rotates the boom 338*b* as indicated by the curved arrow. In the closed position of FIG. 6D, the boom piston 342*b* is retracted to pull the nightcap 332 into the tulip 121*a* as indicated by the downward arrow. In the closed position of FIG. 6D, the clamp 121*b* (FIG. 5B) may be activated to seal with the nightcap 332. The nightcap 332 may be sealed by various means, such as gaskets, sealing pistons, and/or other devices. The process may be reversed to remove the nightcap 332 from the hydraulic disconnect 120.

Figure 5A:
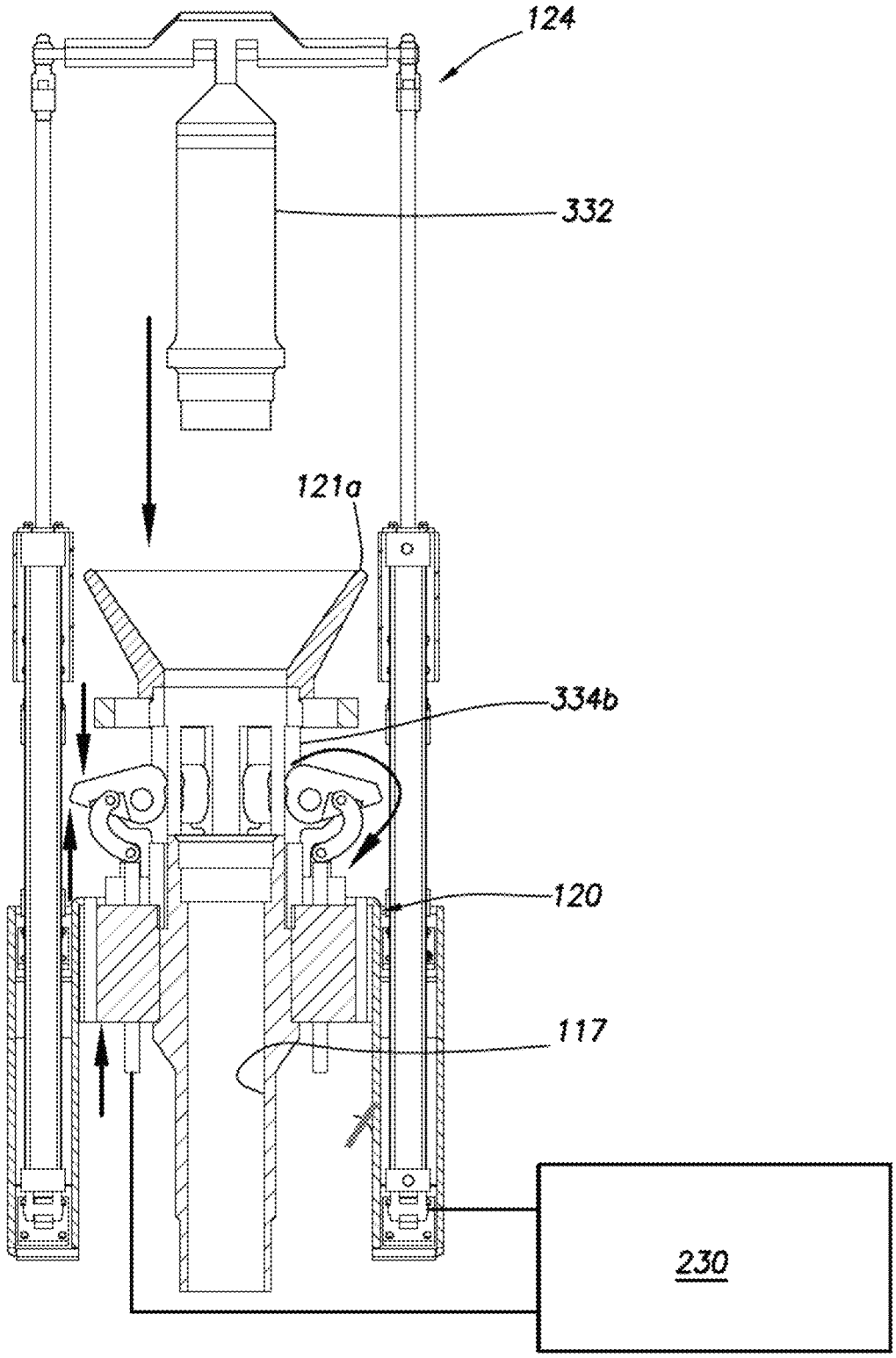
FIGS. 5A-5B are longitudinal cross-sectional views of the wellhead assembly depicting the ring nightcap assembly in an open and a closed position, respectively.

As shown by the example of FIGS. 5A-5B, the nightcap 332 may be sealed in the passage 117 by activating the dogs 336*a* to rotate from the open position of FIG. 5A to the closed position of FIG. 5B. The long bolts extend vertically upward to rotate the pivots 336*b* which then rotate the dogs 336*a*. The dogs 336*a* extend through the openings in the sleeve 334*b* and grippingly engage the nightcap 332. The tulip ring 334*a* may be lowered over the tips 337*c* of the dogs 336*a* to secure (lock) the dogs 336*a* in the sealed position. In this closed position, a downhole end of the nightcap 332 is fittingly received into the shaft 334*d* for sealing engagement therewith thereby securing the well in the closed position.

The ring nightcap assembly 124 may be operated by manual and/or automatic activation. The hydraulic unit 230 may include or be coupled to valves, pistons, or other devices that may be used to move parts of the ring nightcap assembly 124 for actuation thereof. For example, the hydraulic unit 230 may be fluidly coupled to the boom and/or hoist cylinders 342*a*, 344*a* to selectively drive the boom and/or hoist pistons 342*b*, 344*b* to move the nightcap 332 into position. Similarly, the dogs 336*a* may be provided with a piston connected to the long bolts 336*c* to selectively move the long bolts 336*c* and thereby the pivots 336*b* and the dogs 336*a* to selectively seal with the nightcap 332.

Devices, such as controllers (electric, hydraulic, pneumatic, etc.), sensors, communicators, remote controllers, and/or other devices (e.g., surface unit 228 of FIG. 2), may be coupled to the hydraulic unit 230 and/or the ring nightcap assembly 124, the clamp 121*b*, and/or the hydraulic disconnect 120 to trigger actuation thereof (locally and/or remotely). The controllers may include and/or be coupled to the surface unit 228 (FIG. 2) for monitoring and control of operation. The hydraulic unit 230 and/or the surface unit 228 may be provided with remote controllers for remote actuation.

FIGS. 7A-7E show the hydraulic disconnect 120 with a sleeve piston nightcap assembly 724 in a sleeve configuration. These figures show operation of the sleeve nightcap assembly 724 as it places the nightcap 332 into the hydraulic disconnect 120. This version is similar to the previous version, except that the sleeve nightcap assembly 724 has a different configuration. FIGS. 7A-7E show the sleeve nightcap assembly 724 in the retracted, extended, further extended, lifted, and closed position, respectively.

As shown in FIGS. 7A-7E, the sleeve nightcap assembly 724 may include a tubular sleeve 747 positioned on an outer surface of the hydraulic disconnect 120. The sleeve 747 may be interference fit or connected to one or more portions of the hydraulic disconnect 120. Optionally, this sleeve 747 may be incorporated into the hydraulic disconnect 120 for use therewith. As shown, the sleeve 747 is a cylindrical member that fits about a periphery of a portion of the hydraulic disconnect 120, but can be any shape and/or material capable of supporting the sleeve nightcap assembly 724 about the hydraulic disconnect 120.

The sleeve nightcap assembly 724 includes a boom 738*b* and a hoist 738*c*. In this version, the booms 738*b* and the hoists 738*c* are pivotally connected to the sleeve 747 by the connectors 345. Optionally, the booms 738*b* and hoists 738*c* may be connected directly to the hydraulic disconnect 120. The sleeve nightcap assembly 724 may be connected to the hydraulic unit 230 and/or the surface unit 228 for operation therewith (FIGS. 5A-5B).

Figure 7A:
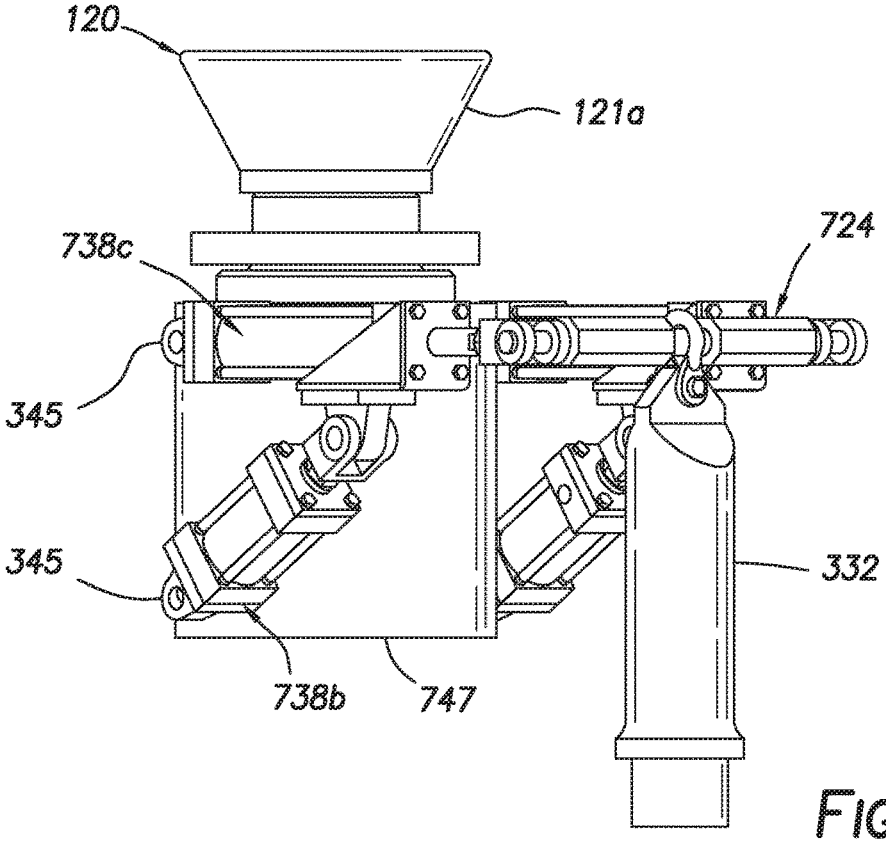
FIGS. 7A-7E are schematic views of another wellhead assembly depicting a sequence of operation of a sleeve nightcap assembly.
Figure 7B:
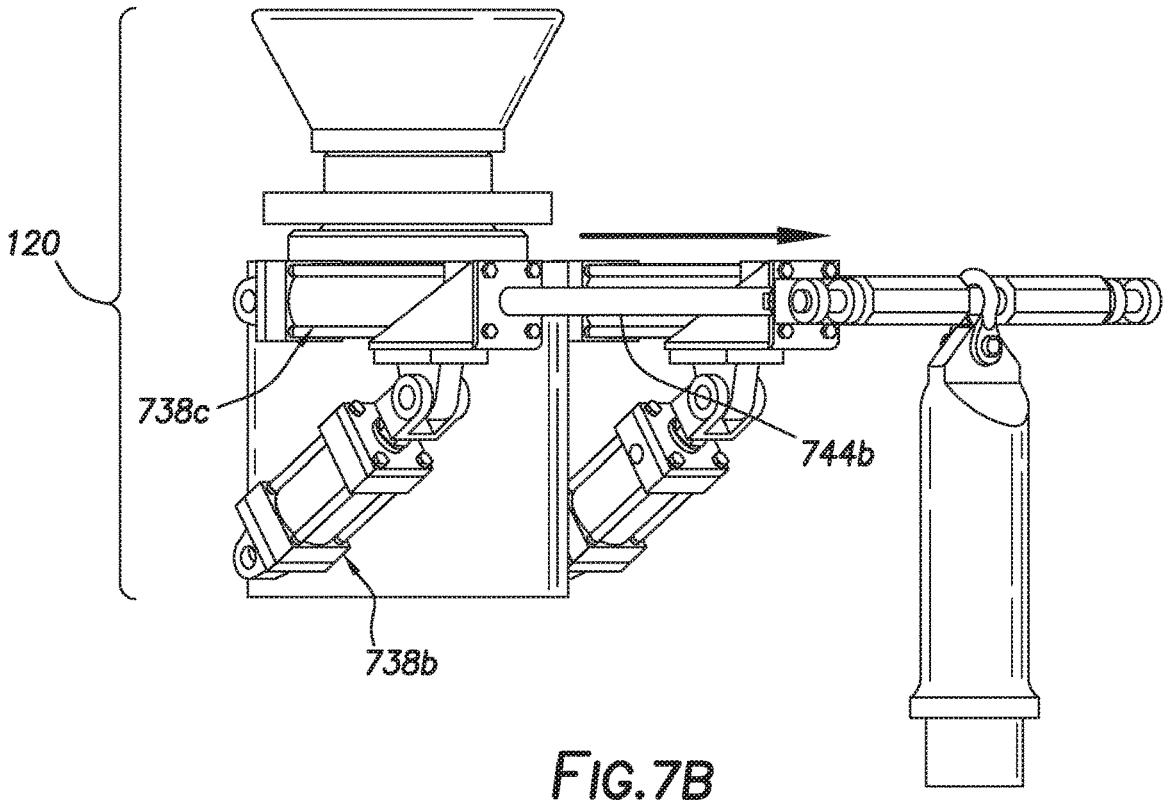
Figure 7C:
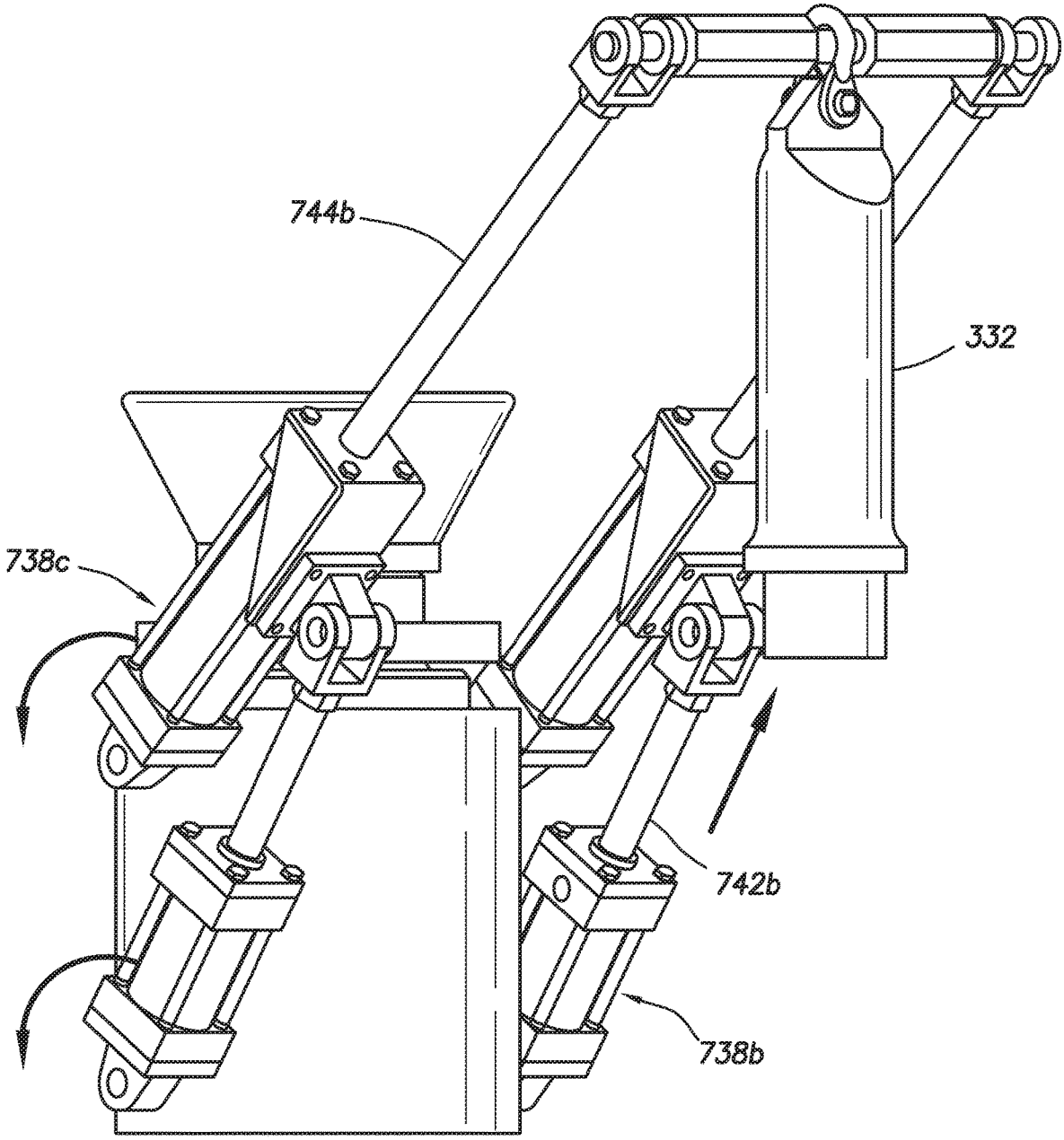
Figure 7D:
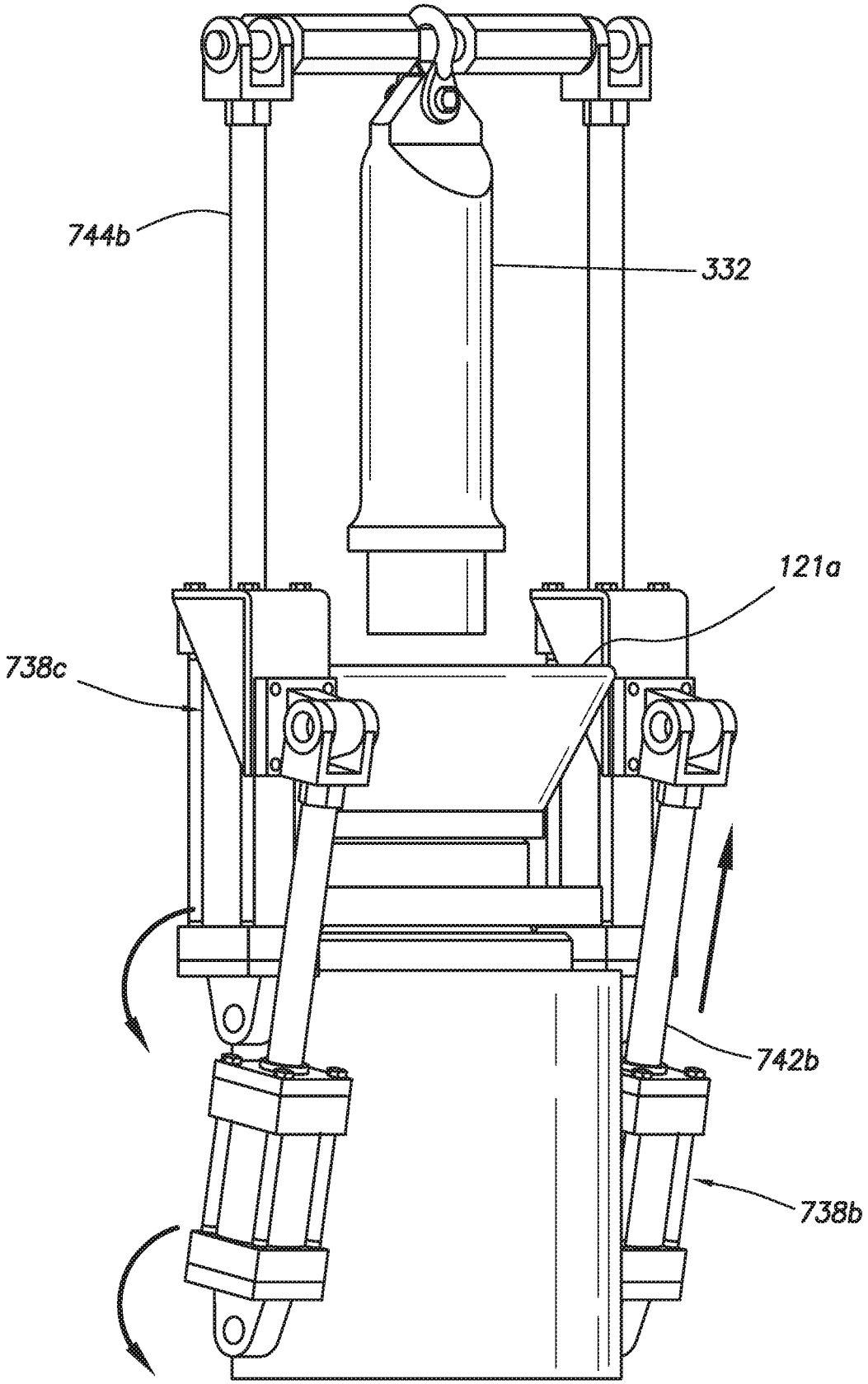
Figure 7E:
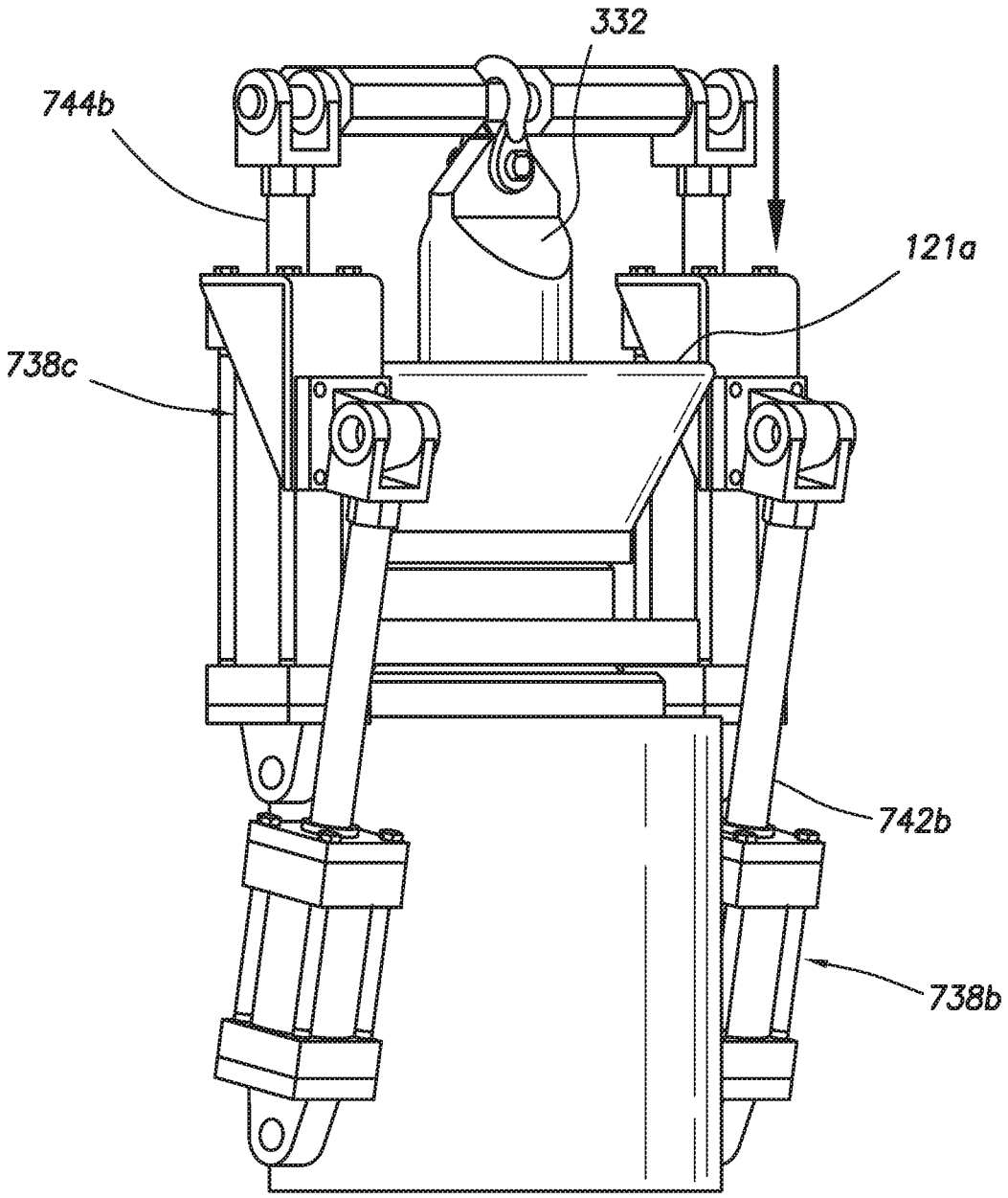

In the retracted position of FIG. 7A, the boom 738*b* and the hoist 738*c* are retracted and the nightcap 332 is at rest adjacent to the open hydraulic disconnect 120. In FIG. 7B, the piston 744*b* of the hoist 738*c* has extended as indicated by the horizontal arrow. In FIG. 7C-7D, the piston 742*b* of the boom 738*b* also extends as indicated by the straight arrow. The extension of piston 742*b* causes the boom 738*b* and the hoist 738*c* to rotate as indicated by the curved arrows until the nightcap 332 is in the vertical position above the tulip 121*a*. In FIG. 7E, the nightcap 332 is lowered into the tulip 121*a* by retraction of the piston 744*b* of the hoist 738*c*. The process may be reversed for removal of the nightcap 332 and/or insertion of the downhole equipment (e.g., 112 of FIG. 1).

Figure 8A:
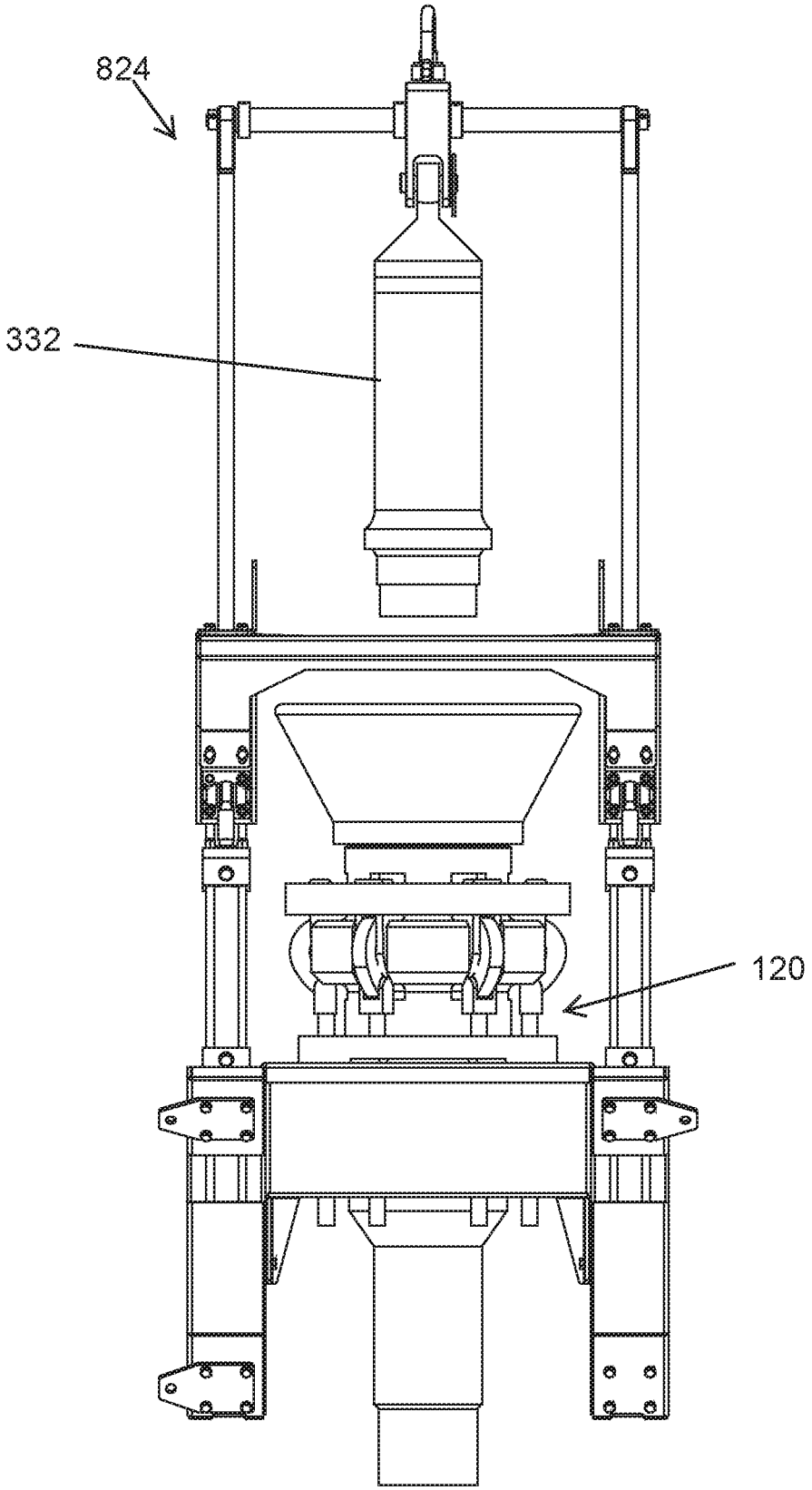
FIGS. 8A-8B are front view and side view, respectively, of the wellhead assembly with a hinged nightcap assembly.
Figure 8B:
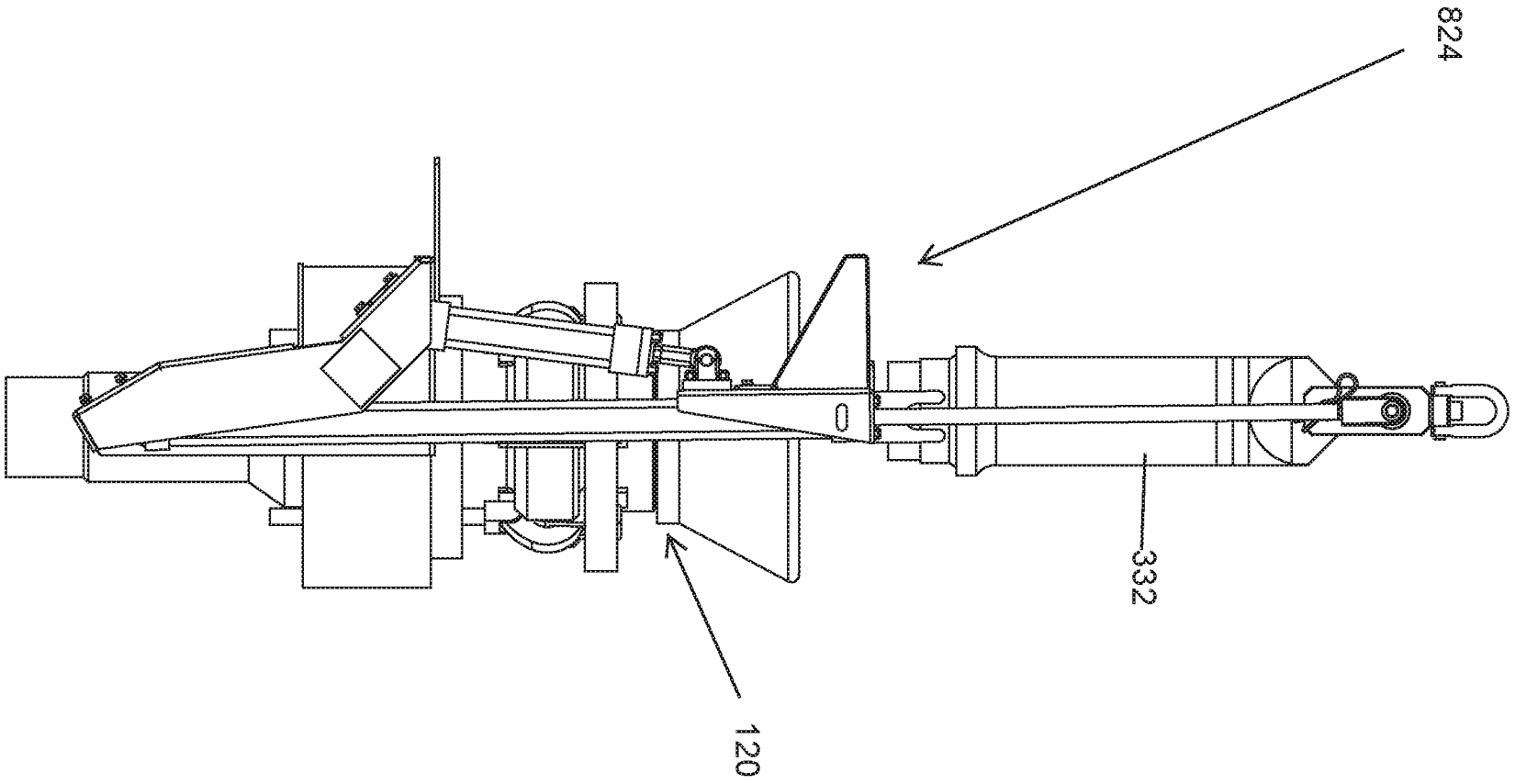
Figure 9:
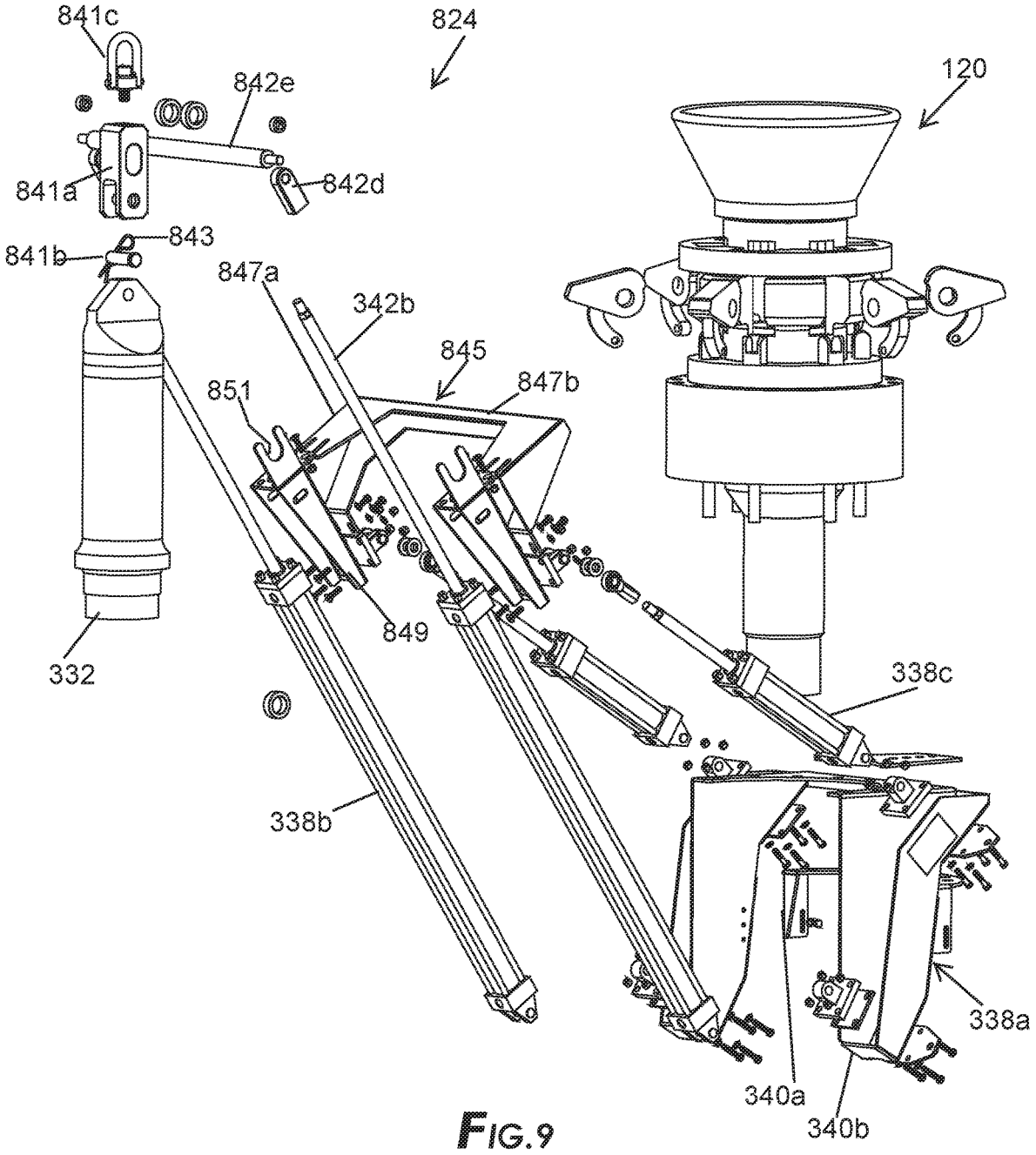
FIG. 9 is an exploded view of the wellhead assembly with the hinged nightcap assembly.
Figure 10A:
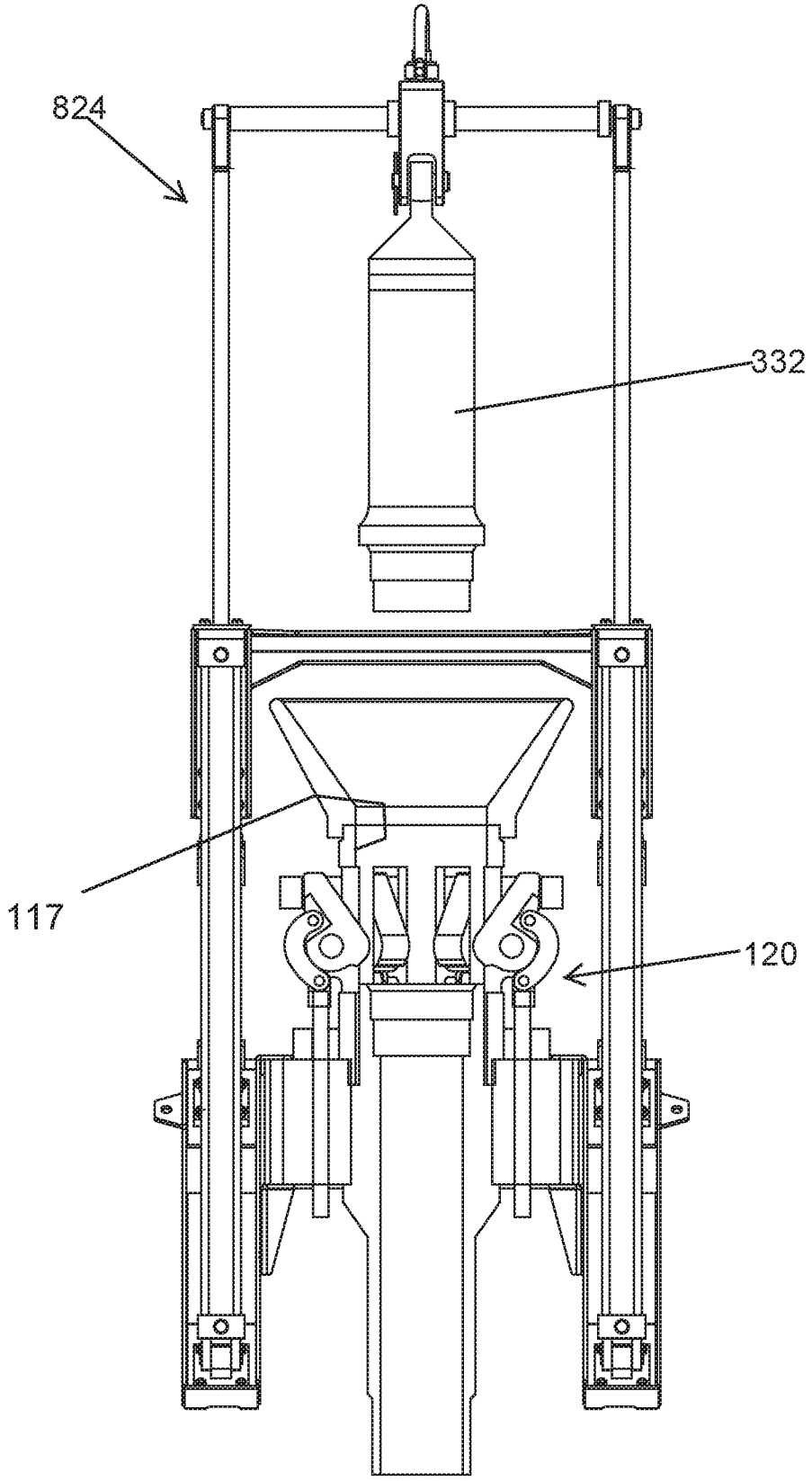
FIGS. 10A-10B are longitudinal cross-sectional views of the wellhead assembly depicting the hinged nightcap assembly in an open and a closed position, respectively.
Figure 10B:
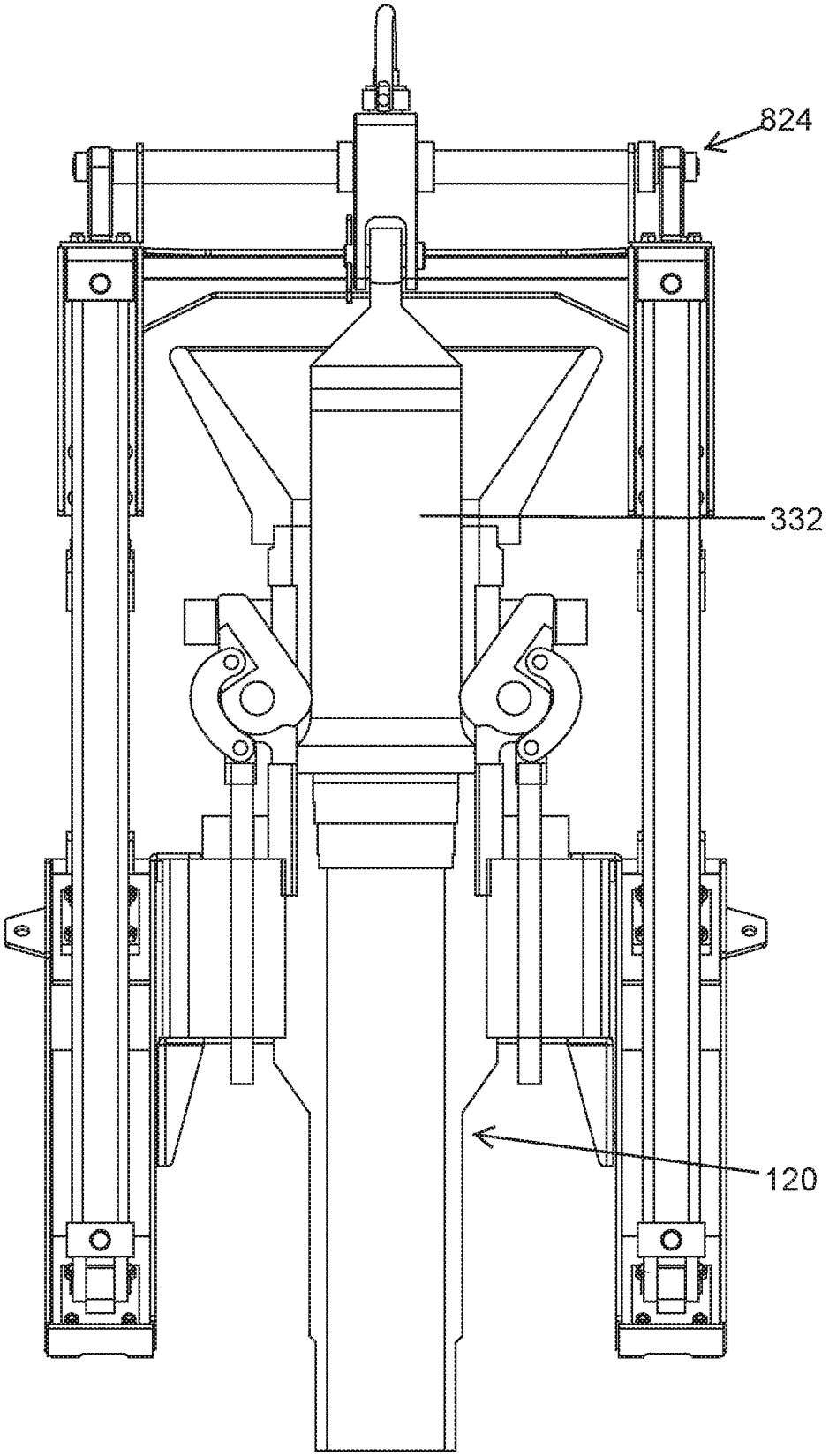

FIGS. 8A-11D show another nightcap assembly 824 in a bracket configuration. FIGS. 8A-10B show various views of the bracket nightcap assembly 824. FIGS. 8A, 8B, and 9 show front, side, and exploded views, respectively, of the hydraulic disconnect 120 and the bracket nightcap assembly 824. FIGS. 10A and 10B show longitudinal cross-sectional views of the bracket nightcap assembly 824 in the open position and the closed position, respectively. FIGS. 11A-11D show an example operation using the bracket nightcap assembly 824. As shown by these figures, the bracket nightcap assembly 824 carries the nightcap 332 for insertion into the passage 117 of the hydraulic disconnect 120. The nightcap 332 is shaped for receipt into the passage 117 and for sealing engagement by the hydraulic disconnect 120.

The hydraulic disconnect 120 is the same as previously described. The bracket nightcap assembly 824 is similar to the ring nightcap assembly 324 of FIGS. 3A-6D, and is provided with similar versions of the nightcap support 338*a*, the boom 338*b*, the hoist 338*c*, support bar 842*e*, and the nightcap 332. As shown by the version of FIGS. 8A-10B, various connectors and supports can be provided to facilitate operation of the nightcap assembly 824. For example, this configuration seeks to ensure proper seating of the nightcap 332 in the hydraulic disconnect 120 without causing interference with the boom 338 or the hoist 338*c* even in the fully retracted position. In another example, this configuration seeks to enable hoisting of the nightcap assembly 824 by crane (e.g., 108 of FIG. 1) without transferring loads to the nightcap assembly 824.

In this version, the sliders 342*c* of FIGS. 3A-6D have been replaced with a lift bracket (u-bracket) 845 connected to each of the booms 338*b*. The lift bracket 845 is a u-shaped member including arms 847*a* joined by a bar 847*b*. Each arm 847*a* is connected to one of the booms 338*b*. Each arm 847*a* is also provided with a key 849. The keys 849 are vertical members with a receptacle 851 at one end and a linear surface engagable with the arm 847*a* to maintain the key 849 in vertical alignment with the boom 338*b*. The receptacle 851 is shaped to receive the support bar 842*e*. The support bar 842*e* is rotatably supported on the pistons 342*b* by eyebolts 842*d*. The support bar 842*e* is provided with connectors to rotatably support the nightcap 332 thereon.

FIGS. 11A-11D show a sequence of operation of the bracket nightcap assembly 824. FIGS. 11A-11D show the bracket nightcap assembly 824 in the retracted, extended, lifted, and closed positions, respectively, in a similar manner as the ring nightcap assembly 324 of FIGS. 6A-6D. In the retracted position of FIG. 11A, the boom piston 342*b* of the boom 338*b* is retracted and the hoist piston 344*b* of the hoist 338*c* is extended. The boom 338*b* is rotated by extension of the hoist piston 344*b* as indicated by the curved arrow. In the extended position of FIG. 6B, the boom piston 342*b* of the boom 338*b* extends to move the nightcap 332 outward as indicated by the arrow.

Figure 11A:
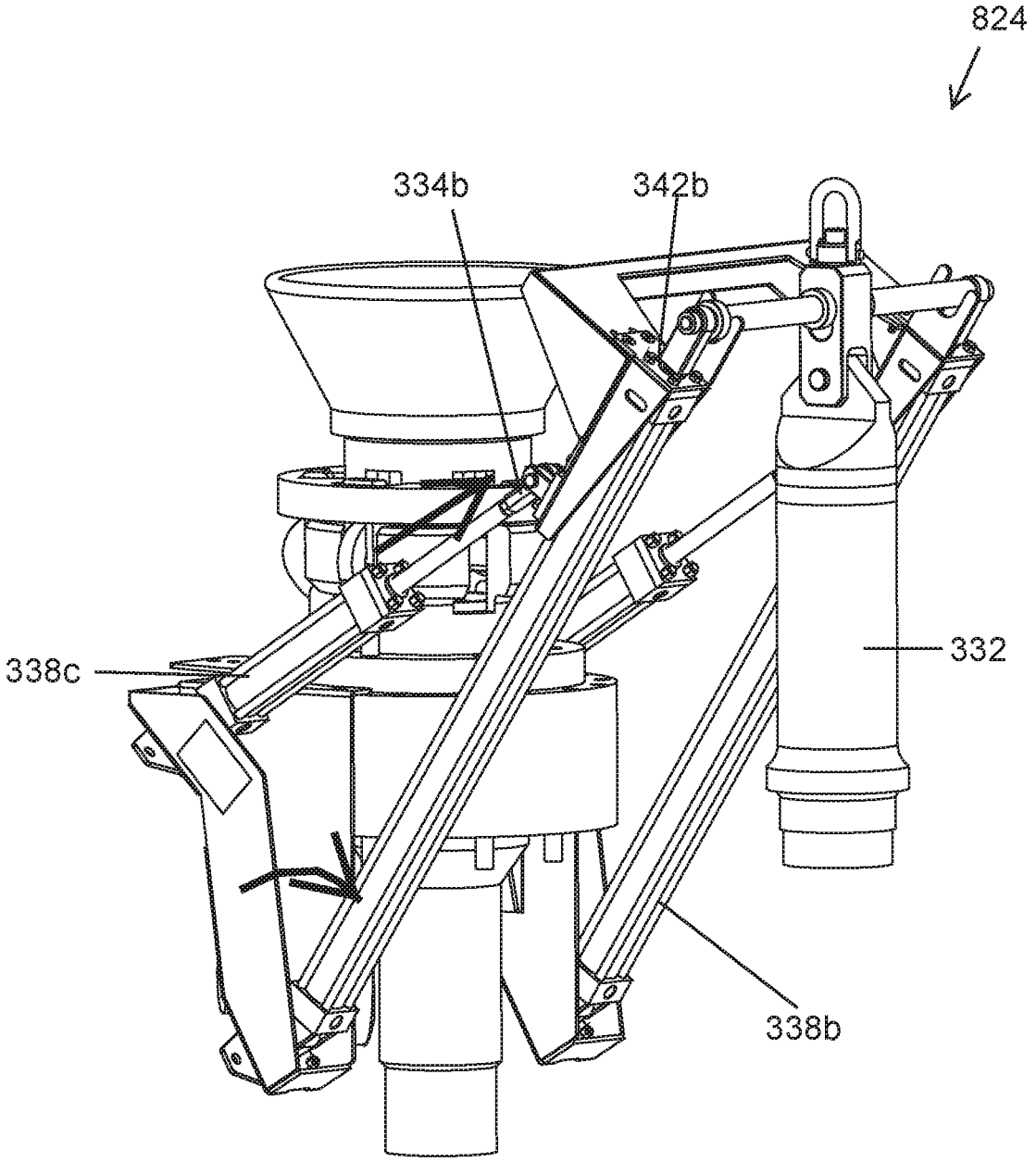
FIGS. 11A-11D are schematic views of the wellhead assembly depicting a sequence of operation of the hinged nightcap assembly.
Figure 11B:
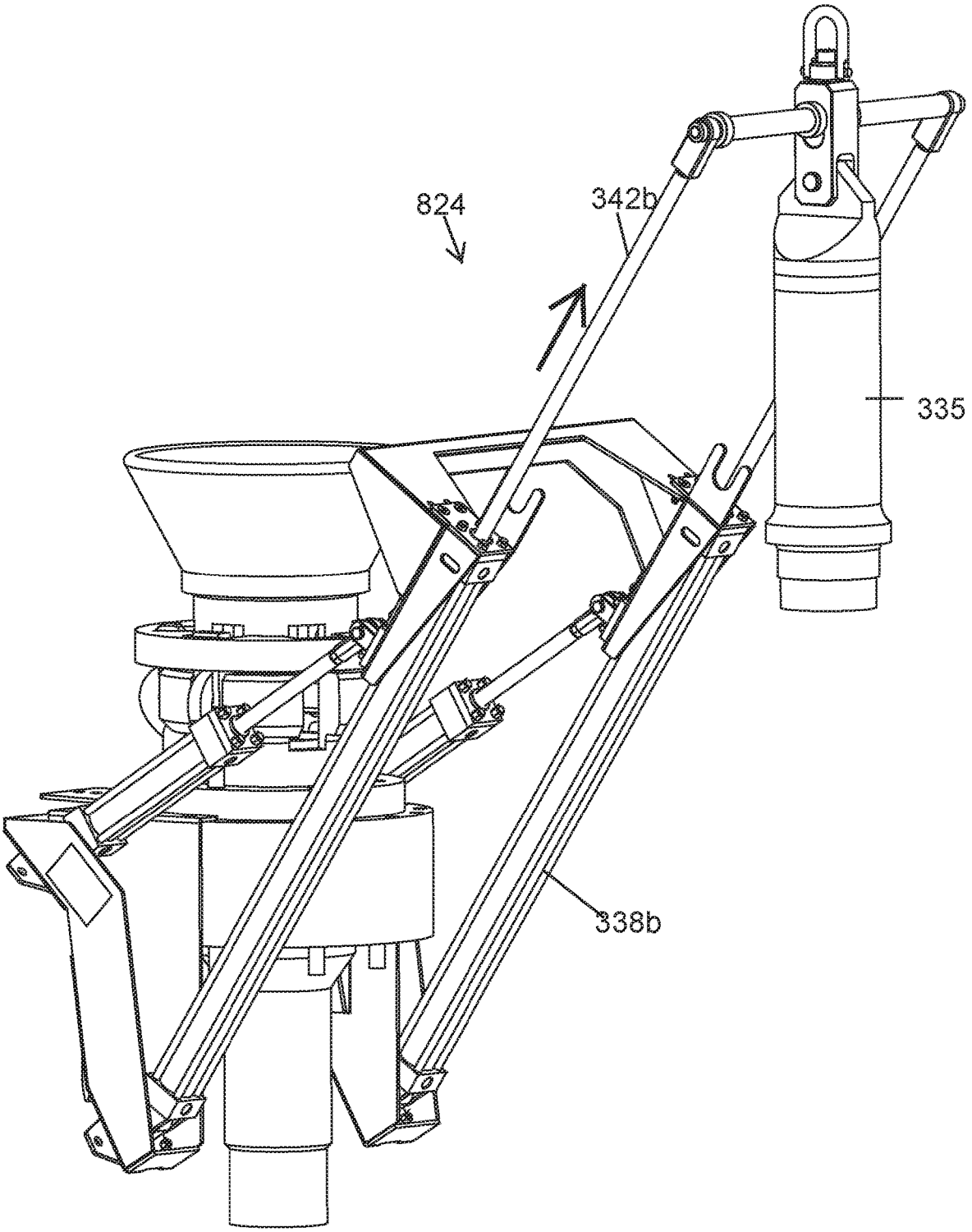
Figure 11C:
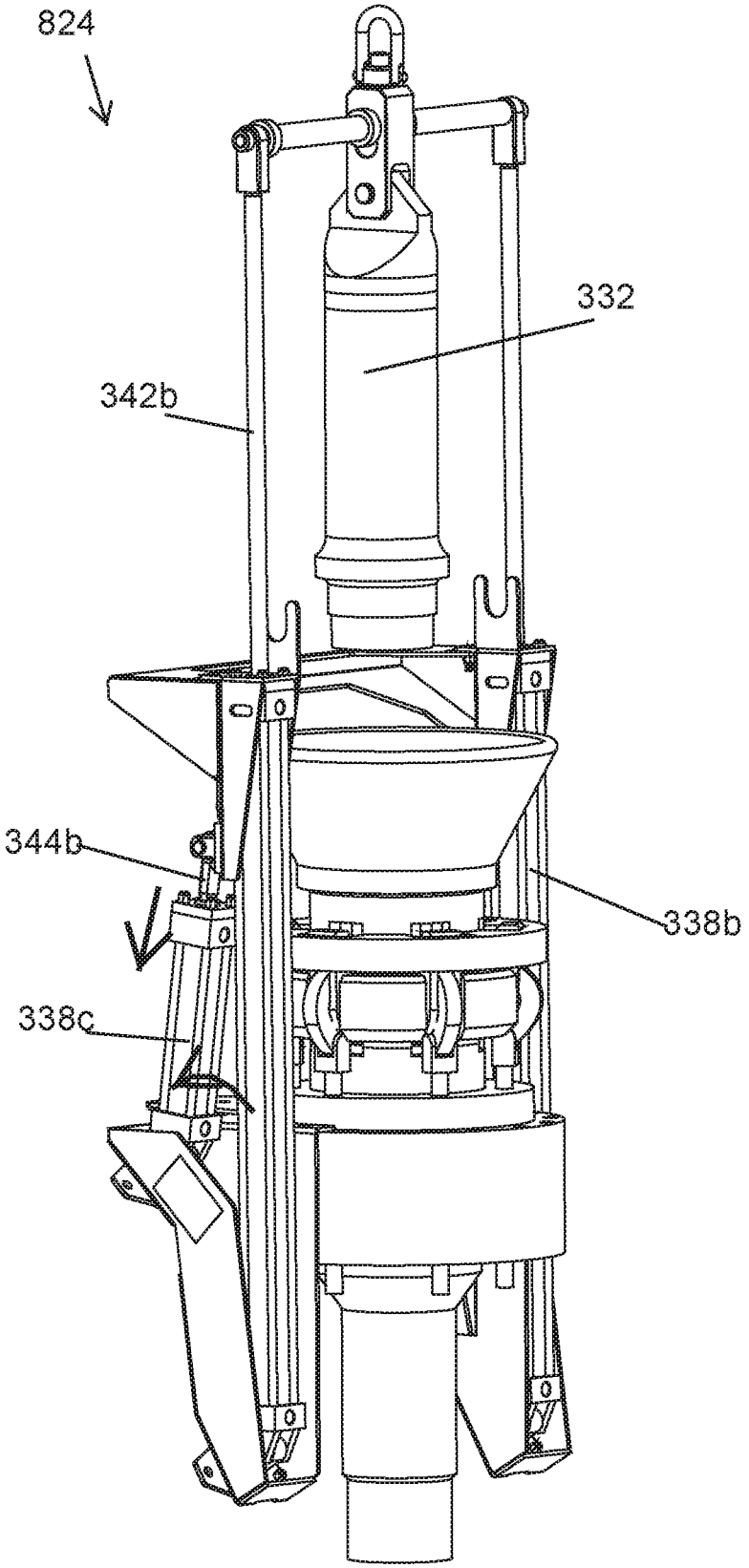
Figure 11D:
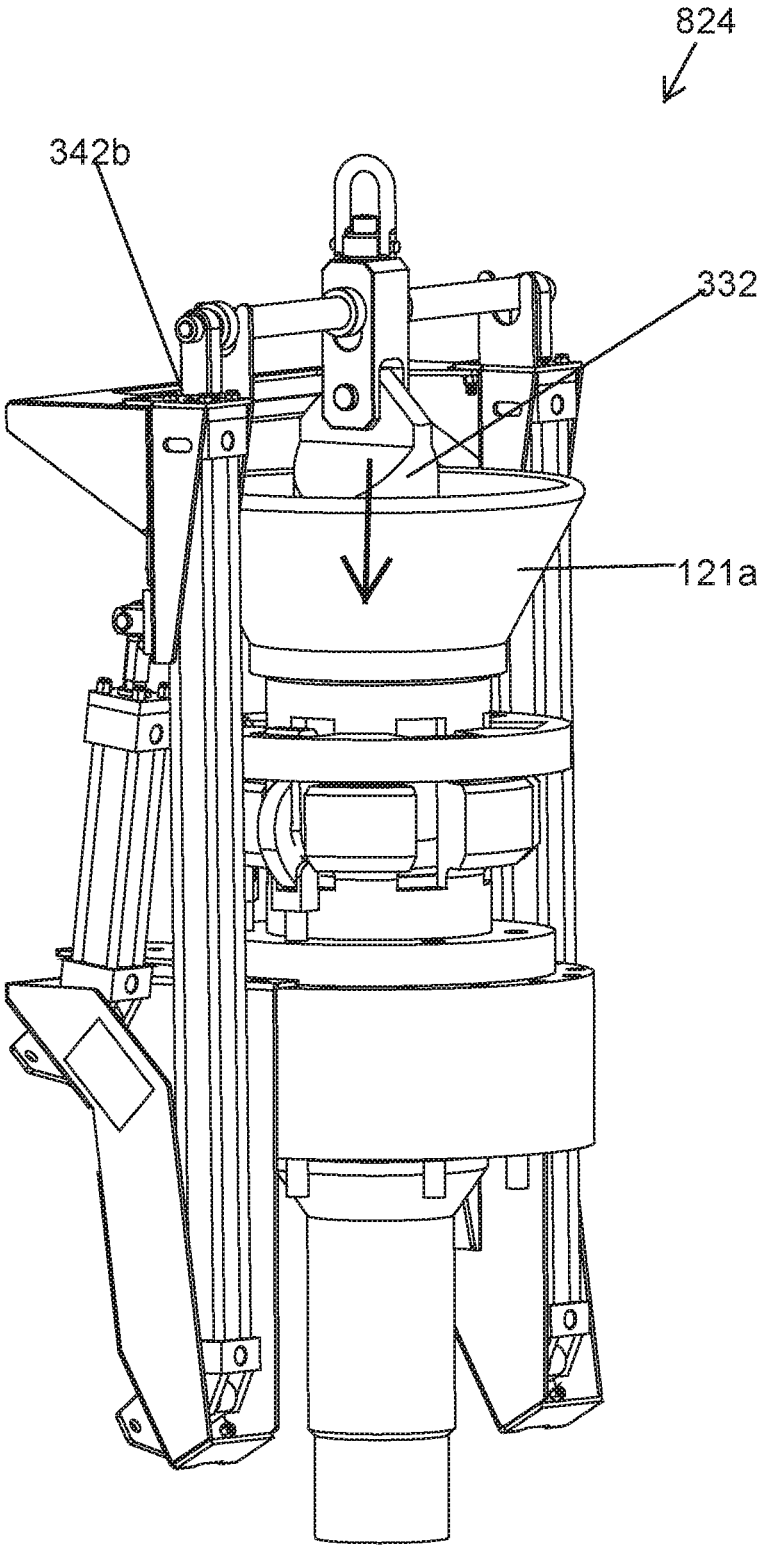

In the lifted position of FIG. 11C, the piston 342*b* of the boom 338*b* remains extended as the piston 344*b* of hoist 338*c* is retracted as indicated by the straight arrow. The retraction of the piston 344*b* rotates the boom 338*b* as indicated by the curved arrow. In the closed position of FIG. 11D, the boom piston 342*b* is retracted to pull the nightcap 332 into the tulip 121*a* as indicated by the downward arrow. In the closed position of FIG. 11D, the clamp 121*b* (FIG. 5B) may be activated to seal with the nightcap 332 as previously described herein for FIGS. 6A-6D. The process may be reversed to remove the nightcap 332 from the hydraulic disconnect 120.

Figure 12A:
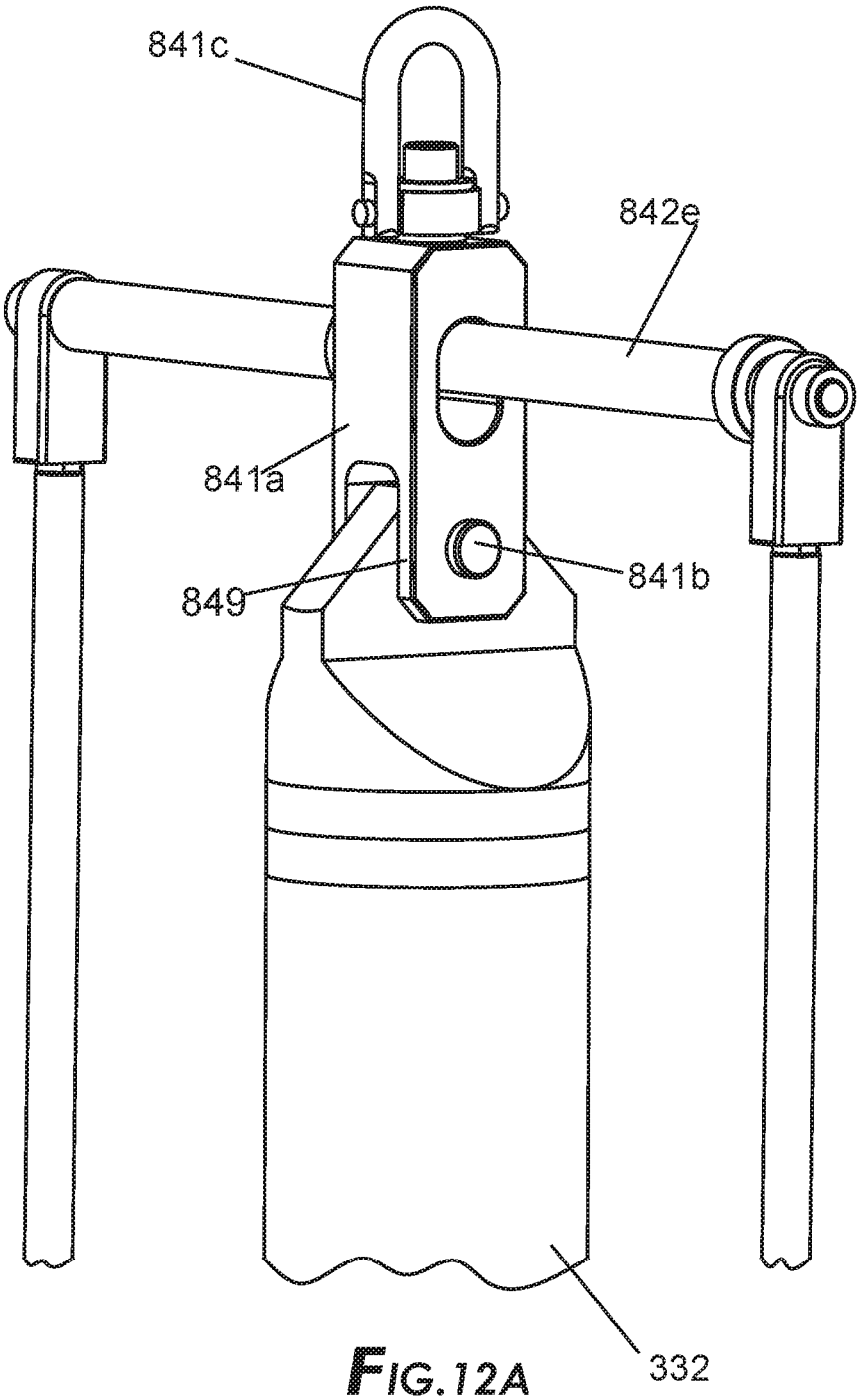
FIGS. 12A-12B are schematic views of portions of nightcap assemblies having booms with lift brackets.
Figure 12B:
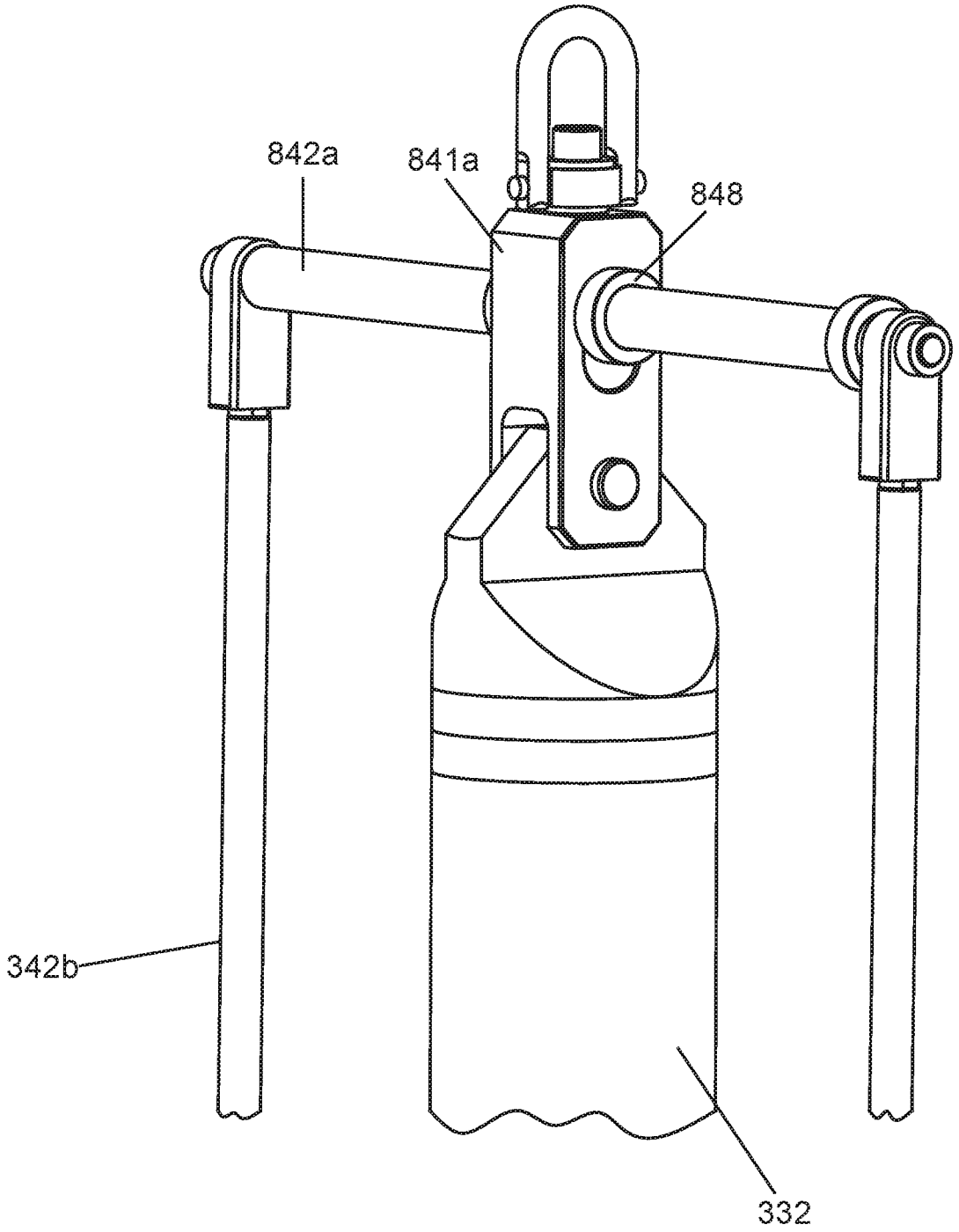

Referring to FIGS. 9, 12A and 12B, the nightcap 332 is supported on the support bar 842*e* by a swivel 841*a* and a pin 841*b*. The swivel 841*a* has a hole shaped to receive the support bar 842*e*, and a keyway 849 shaped to receive an upper end of the nightcap 332. The keyway 849 has holes to receive the pin 841*b*. A locking member (e.g., locking pin) 843 may extend through the pin 841*b* to rotatably secure the pin 841*b* in place. A clasp 841*c* may also be secured to the swivel 841*a* to receive a cable or other supporting member therethrough for lifting the nightcap 332 and/or bracket nightcap assembly 824 (e.g., by crane 108). As shown in FIG. 12B, a collar 848 may optionally be provided about the support bar 842*a* to secure the swivel 841*a* axially along the support bar 842*a* and between the pistons 342*b*.

Figure 13:
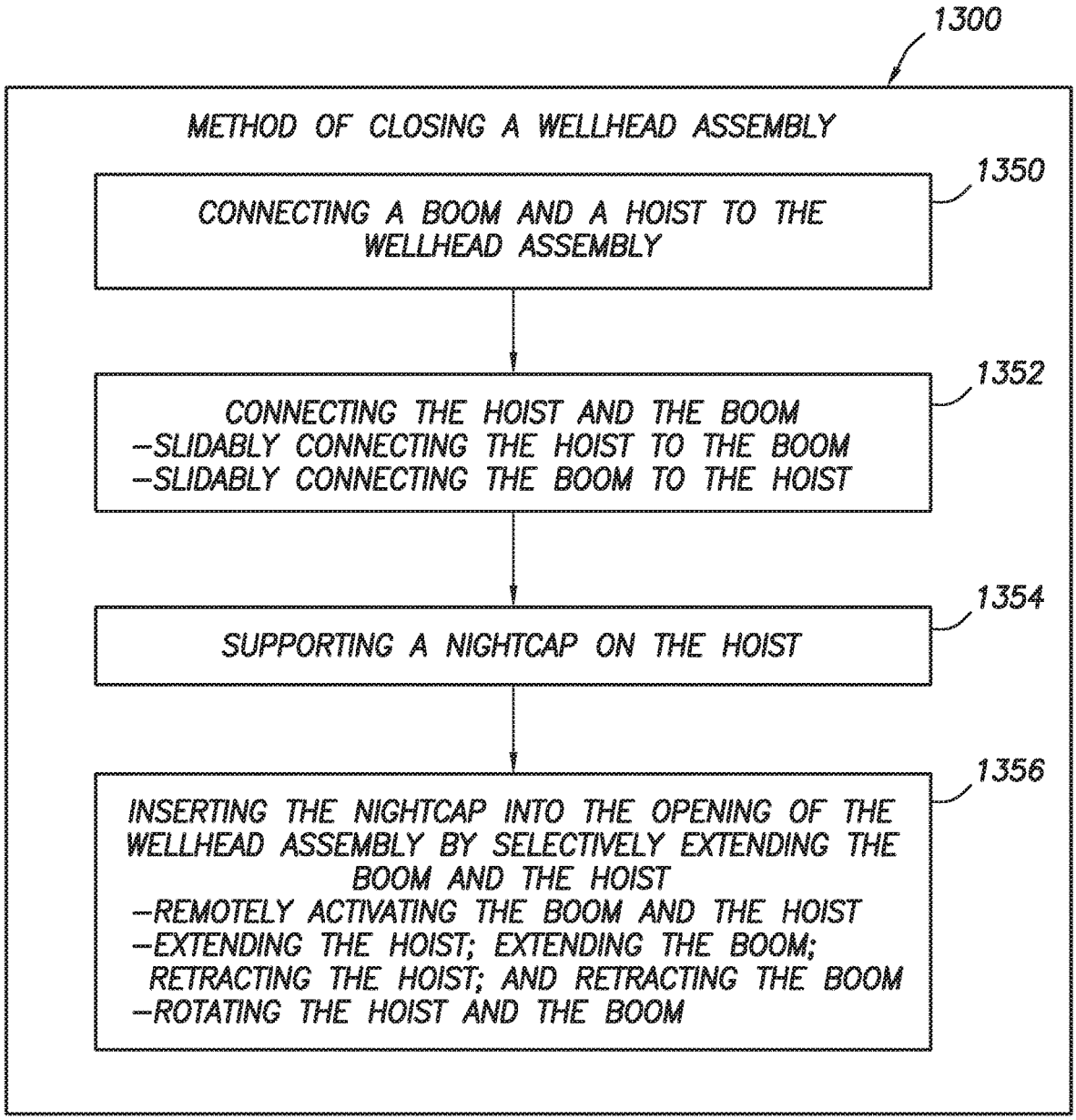
FIG. 13 is a flow chart depicting a method of closing a wellhead assembly.

FIG. 13 is a method flow chart showing a method 1300 of closing a wellhead assembly. The method 1300 comprises: 1350—connecting a boom and a hoist to the wellhead assembly; 1352—connecting the hoist to the boom, 1354—supporting a nightcap on the hoist; and 1356—inserting the nightcap into the opening of the wellhead assembly by selectively extending the boom and the hoist. Portions of the method may be performed in any order and repeated as desired.

The connecting 1352 may involve slidably connecting the hoist to the boom as shown, for example, in FIGS. 6A-6D, slidably connecting the boom to the hoist as shown, for example, in FIGS. 7A-7E, and/or supportingly connecting the boom to the hoist as shown, for example in FIGS. 11A-11D.

The inserting may involve remotely activating the boom and the hoist as shown, for example, in FIGS. 5A-5B. The inserting may also involve extending the hoist; extending the boom; retracting the hoist; and retracting the boom as shown in the examples of FIGS. 6A-6D and/or 7A-7E. FIGS. 6A-7E also show rotating the hoist and the boom during the inserting. FIGS. 11A-11D also show supporting the pistons during the inserting.

While the embodiments are described with reference to various implementations and exploitations, it will be understood that these embodiments are illustrative and that the scope of the inventive subject matter is not limited to them. Many variations, modifications, additions and improvements are possible. For example, various combinations of one or more of the features and/or methods provided herein may be used.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

For example, while certain connectors are provided herein, it will be appreciated that various forms of connection may be provided.

Insofar as the description above and the accompanying drawings disclose any additional subject matter that is not within the scope of the claim(s) herein, the inventions are not dedicated to the public and the right to file one or more applications to claim such additional invention is reserved. Although a very narrow claim may be presented herein, it should be recognized the scope of this invention is much broader than presented by the claim(s). Broader claims may be submitted in an application that claims the benefit of priority from this application.

What is claimed is:

1. A nightcap assembly for closing a wellhead assembly positioned about a wellbore, the nightcap assembly comprising:

a pair of booms, each of the pair of booms comprising a boom cylinder and a boom piston, each of the boom pistons extendable from one of the boom cylinders;

a support member to carry a nightcap, the support member comprising a support bar connected to each of the boom pistons;

a lift bracket comprising arms joined together by a lift bar, each of the arms connected to one of the boom cylinders;

a pair of hoists, each of the pair of hoists comprising a hoist cylinder and a hoist piston, each of the hoist pistons extendable from one of the hoist cylinders, each of the hoist pistons connected to the lift bracket such that the pair of booms are movable by the hoist pistons whereby the nightcap may be positioned for insertion into an opening of the wellhead assembly; and a wellhead support comprising a support ring with wings, the wellhead assembly extending through the support ring and the wings extending from the support ring, the boom cylinders and the hoist cylinders pivotally connected to the wings.

2. The nightcap assembly of claim 1, wherein the wings of the wellhead support are spaced-apart elongate members that extend below the support ring of the wellhead support.

3. The nightcap assembly of claim 2, wherein the support ring of the wellhead support comprises a circular ring positioned on a sleeve ring of the wellhead assembly.

4. The nightcap assembly of claim 1, wherein the pair of hoists is connected by the lift bracket to the pair of booms.

5. The nightcap assembly of claim 4, wherein each of the arms of the lift bracket connects one of the hoist pistons to one of the boom pistons.

6. The nightcap assembly of claim 1, wherein the lift bracket comprises a u-bracket.

7. The nightcap assembly of claim 1, further comprising eyebolts connecting the boom piston to the support member.

8. The nightcap assembly of claim 1, wherein the wellhead assembly comprises a wellhead.

9. The nightcap assembly of claim 8, wherein the wellhead assembly further comprises a hydraulic disconnect.

10. The nightcap assembly of claim 1, wherein the support bar extends between an end of each of the boom pistons.

11. The nightcap assembly of claim 1, further comprising a swivel connecting the nightcap to the support bar.

12. The nightcap assembly of claim 11, further comprising a clasp secured to the swivel.

13. The nightcap assembly of claim 1, further comprising a collar about the support bar.

14. The nightcap assembly of claim 1, further comprising a remote actuator to selectively extend and retract the each of the boom pistons and the each of the hoist pistons.

15. The nightcap assembly of claim 14, wherein the remote actuator comprises a hydraulic pump.

16. A nightcap system for closing a wellhead assembly positioned about a wellbore, the nightcap system comprising:

a nightcap;

a pair of booms, each of the pair of booms comprising a boom cylinder and a boom piston, each of the boom pistons extendable from one of the boom cylinders;

a support member to carry the nightcap, the support member comprising a support bar connected to each of the boom pistons;

a lift bracket comprising arms joined together by a lift bar, each of the arms connected to one of the boom cylinders;

a pair of hoists, each of the pair of hoists comprising a hoist cylinder and a hoist piston, each of the hoist pistons extendable from one of the hoist cylinders, each of the hoist pistons connected to the lift bracket such that the pair of booms are movable by the hoist pistons whereby the nightcap may be positioned for insertion into an opening of the wellhead assembly; and a wellhead support comprising a ring with wings, the wellhead assembly extending through the ring and the wings extending from the ring, the boom cylinders and the hoist cylinders pivotally connected to the wings.

17. The nightcap system of claim 16, further comprising a hydraulic disconnect connected to the wellhead assembly.

18. The nightcap system of claim 17, wherein the hydraulic disconnect comprises a sealer to sealingly engage with the nightcap.

19. The nightcap system of claim 17, wherein the hydraulic disconnect comprises a clamp comprising dogs rotatable into sealing engagement with the nightcap.

20. A method of closing a wellhead assembly positioned about a wellbore, the method comprising:

positioning a wellhead support about the wellhead assembly by extending the wellhead assembly through a ring of the wellhead support;

securing a pair of booms and a pair of hoists to the wellhead assembly by pivotally connecting the pair of booms and the pair of hoists to wings extending from the ring of the wellhead support;

connecting the pair of hoists to the pair of booms by connecting the a hoist piston of each of the pair of hoists to a lift bracket and connecting the lift bracket to the pair of booms;

supporting a nightcap on a boom piston of each of the pair of booms; and inserting the nightcap into an opening of the wellhead assembly by selectively extending the boom pistons and the hoist pistons.

21. The method of claim 20, wherein the inserting comprises remotely activating the pair of booms and the pair of hoists.

22. The method of claim 20, wherein the connecting the pair of hoists to the pair of booms comprises connecting the lift bracket to boom cylinders of each of the pair of booms.

23. The method of claim 20, wherein the connecting the pair of hoists to the pair of booms comprises connecting each arm of the lift bracket to one of the pair of booms.

24. The method of claim 20, wherein the inserting comprises: extending the hoist pistons; extending the boom pistons; retracting the hoist pistons; and retracting the boom pistons.

25. The method of claim 20, wherein the inserting further comprises rotating the pair of hoists and the pair of booms.

26. The method of claim 20, further comprising securing the nightcap in the wellhead assembly by extending locking dogs into engagement with an outer surface of the nightcap.

* * * * *